US011647857B2

(12) United States Patent
O'Nan et al.

(10) Patent No.: US 11,647,857 B2
(45) **Date of Patent: *May 16, 2023**

(54) DRINK CUP

(71) Applicant: Berry Plastics Corporation, Evansville, IN (US)

(72) Inventors: David Y. O'Nan, Henderson, KY (US); Brad A. Ruminer, Evansville, IN (US); Jeffrey A. Mann, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/504,804

(22) Filed: Oct. 19, 2021

(65) Prior Publication Data

US 2022/0031101 A1 Feb. 3, 2022

Related U.S. Application Data

(63) Continuation of application No. 16/593,350, filed on Oct. 4, 2019, now Pat. No. 11,213,147, which is a (Continued)

(51) Int. Cl.
*B65D 1/22* (2006.01)
*A47G 19/23* (2006.01)
(Continued)

(52) U.S. Cl.
CPC ..... *A47G 19/23* (2013.01); *A47G 19/2205* (2013.01); *B65D 1/265* (2013.01); *B65D 1/46* (2013.01); *B65D 21/0212* (2013.01)

(58) Field of Classification Search
CPC ..... B65D 1/265; B65D 1/46; B65D 21/0212; B65D 21/0233; B65D 21/00; B65D 21/02; A47G 19/23; A47G 19/2205
(Continued)

(56) References Cited

U.S. PATENT DOCUMENTS 924,969 A 6/1909 Wolf
D53,069 S 3/1919 Fox
(Continued)

FOREIGN PATENT DOCUMENTS

GB 138770 A 2/1920
GB 2075462 A 11/1981
(Continued)

OTHER PUBLICATIONS

The Society of Plastics Industry, Inc., Glossary of Rigid Plastic Container and Lid Terminology, Technical Bulletin, May 1990, 7 pages.

(Continued)

*Primary Examiner* — John K Fristoe, Jr.
*Assistant Examiner* — Elizabeth J Volz
(74) *Attorney, Agent, or Firm* — Barnes & Thornburg LLP

(57) ABSTRACT

A drink cup includes a body formed to include an interior region providing a fluid-holding reservoir and a brim. The brim is coupled to the body to form an opening into the interior region. The body includes a floor and a side wall that extends away from the floor. The drink cup further includes a body-strengthening system coupled to the body.

20 Claims, 25 Drawing Sheets

Related U.S. Application Data continuation of application No. 15/444,944, filed on Feb. 28, 2017, now Pat. No. 10,477,998.

(60) Provisional application No. 62/301,859, filed on Mar. 1, 2016.

(51) Int. Cl.

| | |
|---|---|
| ***B65D 1/26*** | (2006.01) |
| ***B65D 1/46*** | (2006.01) |
| ***A47G 19/22*** | (2006.01) |
| ***B65D 21/02*** | (2006.01) |

(58) Field of Classification Search

USPC ..... 229/400; 220/660, 669, 670, 671, 672, 220/673, 674, 675, 676; 206/217, 519

See application file for complete search history.

(56) References Cited

U.S. PATENT DOCUMENTS

| | | | | |
|---|---|---|---|---|
| D112,560 | S | 12/1938 | Cunningham | |
| D199,749 | S | 12/1964 | Schnur | |
| 3,298,893 | A | 1/1967 | Allen | |
| 3,512,677 | A | 5/1970 | Kovac | |
| 4,052,037 | A | 10/1977 | Mair | |
| D246,882 | S | 1/1978 | Thrush | |
| 4,124,120 | A | 11/1978 | Day | |
| 4,368,818 | A | 1/1983 | Day | |
| 4,420,081 | A | 12/1983 | Dart | |
| D272,794 | S | 2/1984 | Dart | |
| D397,912 | S | 9/1998 | Goessling, Jr. | |
| 6,047,849 | A | 4/2000 | Schwegman | |
| D429,150 | S | 8/2000 | Lindsay | |
| 6,193,098 | B1 | 2/2001 | Yoichi | |
| 6,260,756 | B1 | 7/2001 | Mochizuki et al. | |
| 6,497,338 | B1 | 12/2002 | Stolzman | |
| D472,425 | S | 4/2003 | Hurlbut | |
| 6,554,154 | B1 | 4/2003 | Chauhan | |
| D474,110 | S | 5/2003 | Sweeney, Jr. | |
| D476,528 | S | 7/2003 | Janky | |
| D514,931 | S | 2/2006 | Snedden | |
| D530,375 | S | 10/2006 | McKnight | |
| D558,524 | S | 1/2008 | Schreitmueller | |
| D565,352 | S | 4/2008 | Williams | |
| D572,083 | S | 7/2008 | Tien | |
| 7,546,932 | B2 * | 6/2009 | Smith | B65D 1/46 220/675 |
| D601,852 | S | 10/2009 | Newman | |
| D606,808 | S | 12/2009 | Germann | |
| 7,665,627 | B2 | 2/2010 | Shibata | |
| 7,882,975 | B2 | 2/2011 | Kelly | |
| D644,066 | S | 8/2011 | Hotell | |
| D658,443 | S | 5/2012 | Chiu | |
| 8,245,847 | B2 | 8/2012 | Davis | |
| 8,281,953 | B2 | 10/2012 | Yourist | |
| 8,328,043 | B2 | 12/2012 | Kessell | |
| 8,336,732 | B1 | 12/2012 | Tobias | |
| 8,365,945 | B2 | 2/2013 | Yourist | |
| D680,377 | S | 4/2013 | Romley | |
| D680,378 | S | 4/2013 | Romley | |
| D687,262 | S | 8/2013 | Bucceri | |
| 8,646,646 | B2 | 2/2014 | Yourist | |
| 8,667,662 | B2 | 3/2014 | Kelly | |
| 8,777,046 | B2 | 7/2014 | Mann | |
| 8,783,505 | B2 | 7/2014 | Yourist | |
| D717,605 | S | 11/2014 | Kristinik | |
| D717,606 | S | 11/2014 | Kristinik | |
| 8,887,942 | B2 | 11/2014 | Miksovsky | |
| D721,887 | S | 2/2015 | Romley | |
| D732,343 | S | 6/2015 | Romley | |
| 9,161,661 | B2 | 10/2015 | Kelly | |
| D742,221 | S | 11/2015 | Casiddu | |
| D742,695 | S | 11/2015 | Pendleton | |
| D746,635 | S | 1/2016 | Lapsker | |
| 9,248,932 | B2 | 2/2016 | Gamber | |
| 9,266,660 | B2 | 2/2016 | Cai | |
| 9,314,089 | B2 | 4/2016 | Hodge | |
| 9,351,596 | B2 | 5/2016 | Karam | |
| 9,440,410 | B2 | 9/2016 | Marshall | |
| D772,013 | S | 11/2016 | O'Connor | |
| D790,277 | S | 6/2017 | MacKesy, II | |
| D795,643 | S | 8/2017 | Barlow | |
| D796,265 | S | 9/2017 | Lapsker | |
| D797,510 | S | 9/2017 | Ke | |
| D813,606 | S | 3/2018 | O'Nan | |
| 10,246,220 | B2 | 4/2019 | Buck | |
| 10,294,008 | B2 | 5/2019 | Marshall | |
| D851,998 | S | 6/2019 | O'Nan | |
| D852,000 | S | 6/2019 | Zou | |
| 10,477,998 | B2 * | 11/2019 | O'Nan | B65D 1/46 |
| 10,478,000 | B2 | 11/2019 | Choi | |
| D873,616 | S | 1/2020 | Kaiser | |
| D896,073 | S | 9/2020 | Temple, Jr. | |
| D897,781 | S | 10/2020 | Hirsch | |
| D903,424 | S | 12/2020 | Scott | |
| D904,124 | S | 12/2020 | Hinds | |
| D906,056 | S | 12/2020 | Scott | |
| D914,494 | S | 3/2021 | O'Malley | |
| 11,213,147 | B2 * | 1/2022 | O'Nan | B65D 1/46 |
| 2002/0130170 | A1 | 9/2002 | Nakashima | |
| 2005/0173287 | A1 | 8/2005 | Smith | |
| 2005/0189361 | A1 * | 9/2005 | Bresler | B65D 1/265 220/703 |
| 2007/0117702 | A1 | 5/2007 | Okushita | |
| 2009/0223969 | A1 | 9/2009 | Bouie | |
| 2012/0205371 | A1 | 8/2012 | Lee | |
| 2012/0247998 | A1 | 10/2012 | Wahl | |
| 2012/0318805 | A1 | 12/2012 | Leser | |
| 2013/0334233 | A1 | 12/2013 | Vandenlangenberg | |
| 2014/0069942 | A1 | 3/2014 | Duquenoy | |
| 2014/0091086 | A1 | 4/2014 | Sorensen | |
| 2015/0041478 | A1 | 2/2015 | Abrams | |
| 2015/0251808 | A1 | 9/2015 | Tsui | |
| 2015/0253055 | A1 | 9/2015 | Tsui | |
| 2015/0291309 | A1 | 10/2015 | McGregor | |
| 2015/0374152 | A1 | 12/2015 | Anshu | |
| 2016/0075464 | A1 | 3/2016 | Turner | |
| 2016/0122080 | A1 | 5/2016 | Blatstein | |
| 2016/0159528 | A1 | 6/2016 | Kessell | |
| 2016/0214756 | A1 | 7/2016 | Hodge | |
| 2016/0332805 | A1 | 11/2016 | Krupa | |
| 2017/0251852 | A1 | 9/2017 | O'Nan | |

FOREIGN PATENT DOCUMENTS

| | | |
|---|---|---|
| GB | 2146232 B | 7/1986 |
| GB | 4010581 | 4/2009 |
| GB | 4010589 | 4/2009 |
| GB | 4010594 | 4/2009 |
| GB | 90061670110001 | 2/2019 |
| GB | 90077479020004 | 3/2020 |
| GB | 90077479020005 | 3/2020 |
| GB | 90077479020006 | 3/2020 |
| GB | 90080577310001 | 7/2020 |
| GB | 2582856 A | 10/2020 |

OTHER PUBLICATIONS

Office Action dated Aug. 3, 2018 for U.S. Appl. No. 29/595,453, BP-497 US-DES || (pp. 1-5).

Office Action dated Oct. 24, 2018 for U.S. Appl. No. 15/444,944, BP-497 US-U || (pp. 1-10).

Office Action dated Apr. 19, 2019 for U.S. Appl. No. 15/444,944, BP-497 US-U || pp. 1-9.

Office Action dated Sep. 4, 2020 for U.S. Appl. No. 16/593,350 (pp. 1-10).

Office Action dated Apr. 23, 2021 for U.S. Appl. No. 29/690,129, BP-497 US-DES2 || (pp. 1-4).

https://www.amazon.com/Silicone-Collapsible-Travel-Cup-Expandable/dp/B07RHH7YKC/ref=sr_1_90?dchild=1&keywords=foldable+cup&qid=1617306424&sr=8-90 (Year: 2019), 4 pages.

(56) References Cited

OTHER PUBLICATIONS

Office Action dated Mar. 25, 2021 for U.S. Appl. No. 16/593,350, BP-497 US-CON II (pp. 1-11).

* cited by examiner

DRINK CUP

PRIORITY CLAIM

This application is a continuation of U.S. patent application Ser. No. 16/593,350, filed Oct. 4, 2019, which is a continuation of U.S. Pat. No. 10,477,998, filed Feb. 28, 2017, which claims priority under 35 U.S.C. § 119(e) to U.S. Provisional Application No. 62/301,859, filed Mar. 1, 2016, each of which is expressly incorporated by reference herein.

BACKGROUND

The present disclosure relates to containers, and particularly to cups. More particularly, the present disclosure relates to drink cups.

SUMMARY

A drink cup in accordance with the present disclosure includes a body and a brim. The body is formed to include an interior region providing a fluid-holding reservoir and the brim is coupled to the body to frame an opening into the interior region.

In illustrative embodiments, the drink cup includes a body-strengthening system configured to provide means for minimizing a weight of a drink cup while maximizing rigidity of a selected portion of the drink cup so that unintended deformation of the drink cup is minimized.

In illustrative embodiments, the body-strengthening system includes a first strengthening unit located between a lower portion of the side wall and a middle portion of the side wall. In illustrative embodiments, the first strengthening unit includes an upper-strengthening segment and a C-shaped lower-strengthening segment. The upper-strengthening segment is located between the C-shaped lower-strengthening segment and the middle portion of the side wall. The C-shaped lower-strengthening segment is located between the upper-strengthening segment and the lower portion of the side wall.

In illustrative embodiments, the body-strengthening system further includes a second strengthening unit located between the first strengthening unit and the brim. The second strengthening unit includes a C-shaped annular ring and an annular strip. Illustratively, the C-shaped annular ring is located between the annular strip and the middle portion of the side wall.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which:

FIG. 1 is a perspective view of a first embodiment of a drink cup in accordance with the present disclosure showing the drink cup includes a body formed to include an interior region, a brim coupled to an upper portion of a side wall included in the body, and a body-strengthening system coupled to the body and including a first strengthening unit and a second strengthening unit;

FIG. 2 is an enlarged perspective view taken from FIG. 1 showing from top-to-bottom a middle portion of the side wall, the first strengthening unit, and a bottom portion of the side wall, the first strengthening unit including an upper-strengthening segment and a C-shaped strengthening segment, the upper-strengthening segment is located between the C-shaped strengthening segment and the middle portion of the side wall and the C-shaped strengthening segment is located between the upper-strengthening segment and the lower portion of the side wall;

FIG. 3 is an enlarged perspective view taken from FIG. 2 showing from top to bottom the brim, a stack shoulder, an upper portion of the side wall, the second strengthening unit, and the middle portion of the side wall, the second strengthening unit including a C-shaped annular ring coupled to the upper portion of the side wall and an annular strip extending between and interconnecting the C-shaped annular ring and the middle portion of the side wall;

FIG. 4 is a sectional view taken along line 4-4 of FIG. 1 showing the drink cup includes from top-to-bottom along the central axis the brim, the stack shoulder, the upper-portion of the side wall, the second strengthening unit, the middle portion of the side wall, the first strengthening unit, the lower portion of the side wall, and the floor;

FIG. 5 is an enlarged dead section of the sectional view of FIG. 4 showing the first strengthening unit relative to the central axis and extending between and interconnecting the middle portion of the side wall with the lower portion of the side wall, and further showing the first strengthening unit includes the upper-strengthening segment including an annular strip coupled to the middle portion of the side wall and an annular band located a first distance from the central axis and extending between and interconnecting the annular strip and the C-shaped strengthening segment, the C-shaped strengthening segment extending between and interconnecting the annular band and the lower portion of the side wall and including a first annular strip, a second annular strip, and an annular band located between the first annular strip and the second annular strip, the annular band located a second distance from the central axis which is generally greater than the first distance of the annular band of the upper-strengthening segment to the central axis;

FIG. 6 is an enlarged dead section of the sectional view of FIG. 4 showing the second strengthening unit relative to the central axis and extending between and interconnecting the middle portion of the side wall and the upper portion of the side wall and further showing the second strengthening unit including from top to bottom a C-shaped annular ring and an annular bottom strip extending between and interconnecting the C-shaped annular ring and the middle portion of the side wall, the C-shaped annular ring including a first annular strip coupled to the upper portion of the side wall, a second annular strip coupled to the bottom strip, and an annular band extending between and interconnecting the first annular strip and the second annular strip and located a third distance from the central axis which is generally less than a fourth distance located between the middle portion of the side wall and a fifth distance located between the central axis and the upper portion of the side wall;

DETAILED DESCRIPTION

Figure 1:
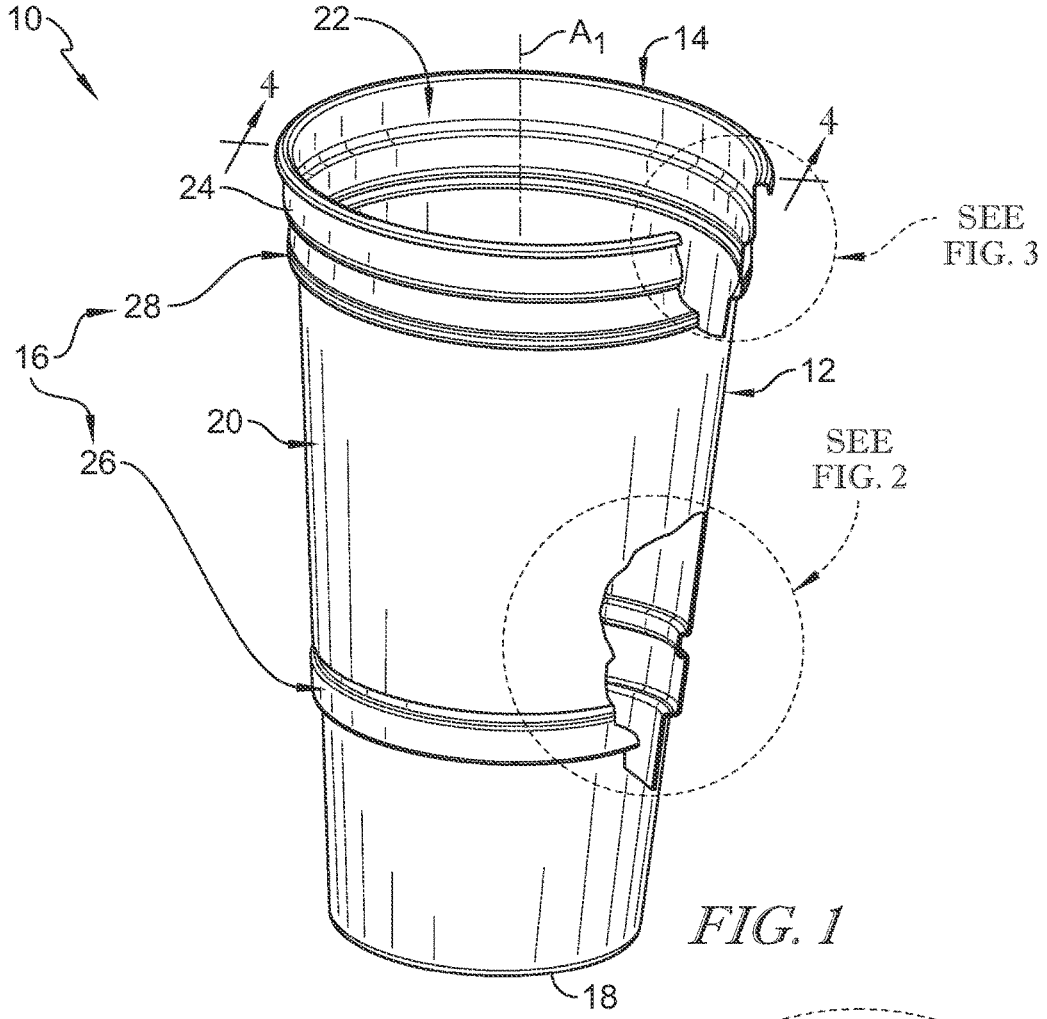

A drink cup 10 includes a body 12, a brim 14, and a body-strengthening system 16 as shown in FIGS. 1-4. Body 12 includes a floor 18 and a side wall 20 that cooperate to form an interior region 22. Brim 14 is coupled to body 12 to frame an opening into interior region 22. Body-strengthening system 16 is coupled to body 12 between floor 18 and brim 14 and is configured to provide means for minimizing a weight of drink cup 10 while maximizing the rigidity of a selected portion of drink cup 10 so that unintended deformation of drink cup 10 is minimized. Additional embodiments of drink cups 110, 210, 310, 410, 510, 610, 710, 810, 910, 1010, 1110, 1210, 1310, 1410, 1510, 1610, 1710, 1810, 1910, and 2010 are shown in FIGS. 7-26. A rigidity tester used to measure side wall rigidity is shown in FIG. 27.

Body 12 includes floor 18, side wall 20, and stack shoulder 24. Floor 18 cooperates with side wall 20 to define interior region 22 to hold fluid therein. Side wall 20 extends away from floor 18 towards brim 14 along a central axis A1 as shown in FIGS. 1 and 4. Stack shoulder 24 extends between and interconnects side wall 20 and brim 14, as shown in FIG. 3.

Figure 3:
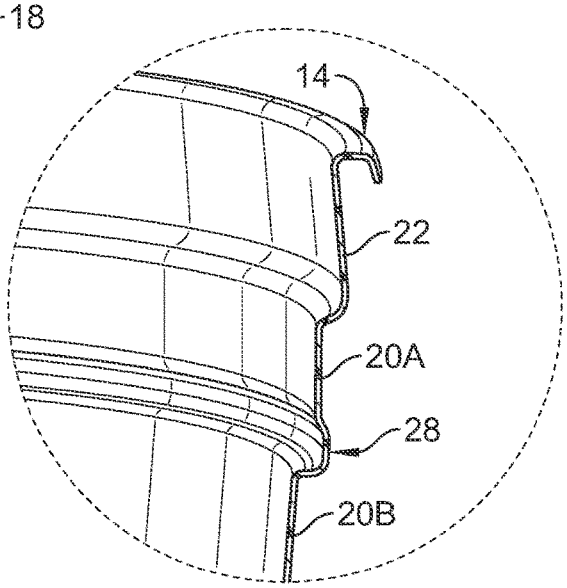
Figure 4:
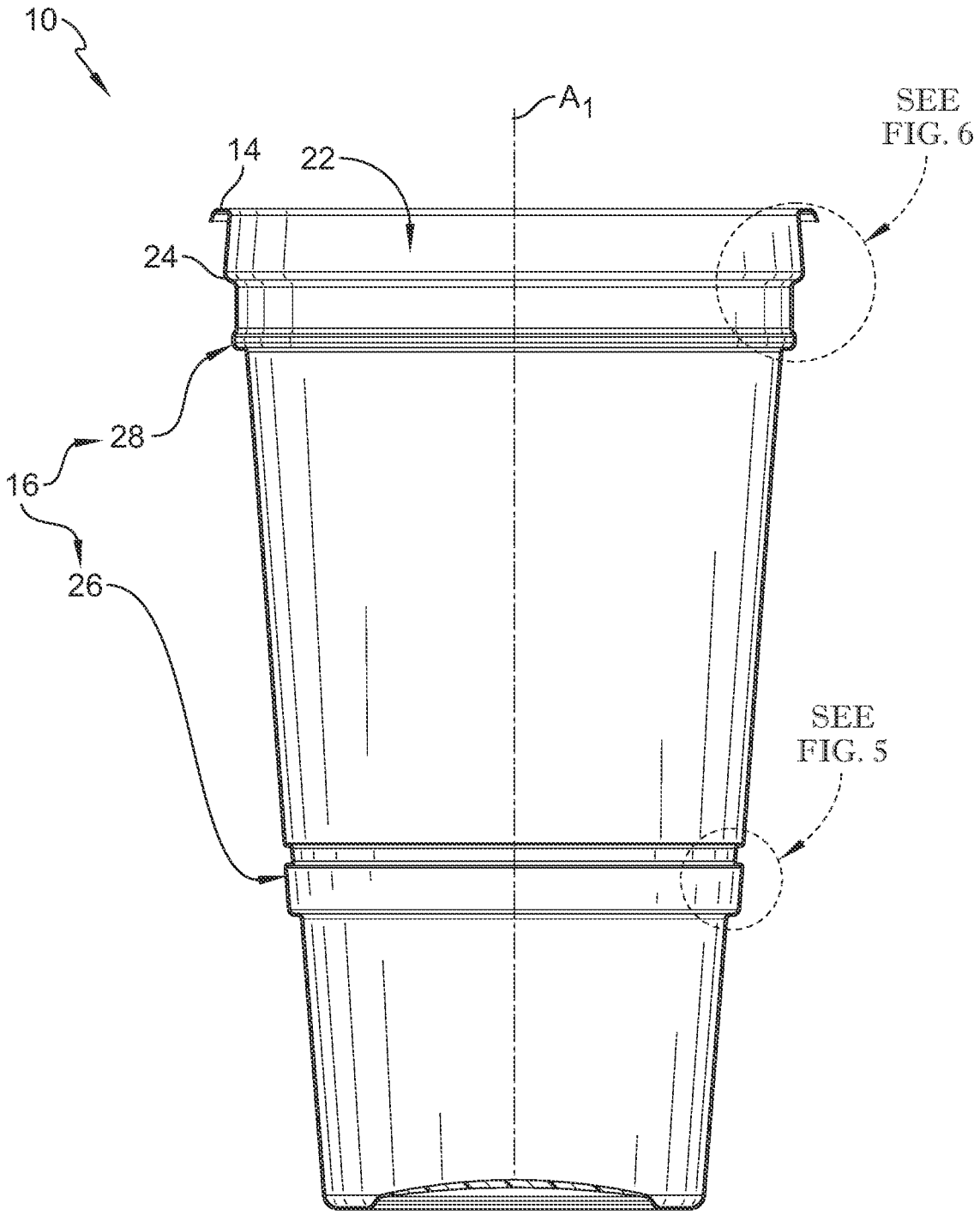

Brim 14 is coupled to stack shoulder 24 and is configured to frame an opening into interior region 22, as shown in FIGS. 1 and 3. Brim 14 is adapted to couple to a lid to establish a package. The package includes drink cup 10 and the lid coupled to the brim 14. The lid is arranged to block selectively access to interior region 22 of drink cup 10. Illustratively, brim 14 provides a continuous smooth surface as shown in FIGS. 1 and 3.

Figure 2:
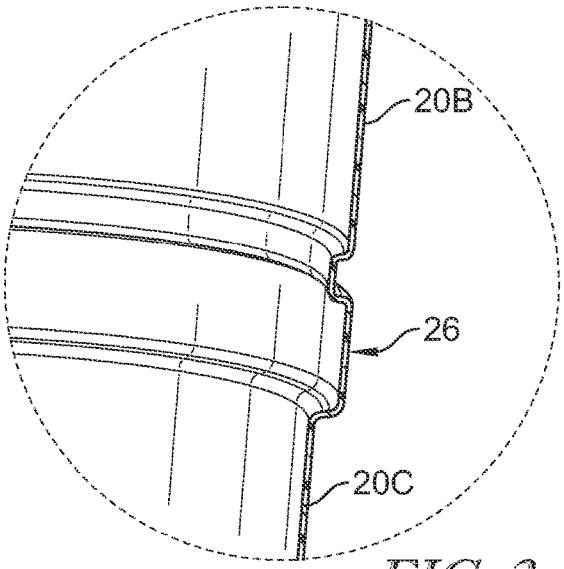
Figure 5:
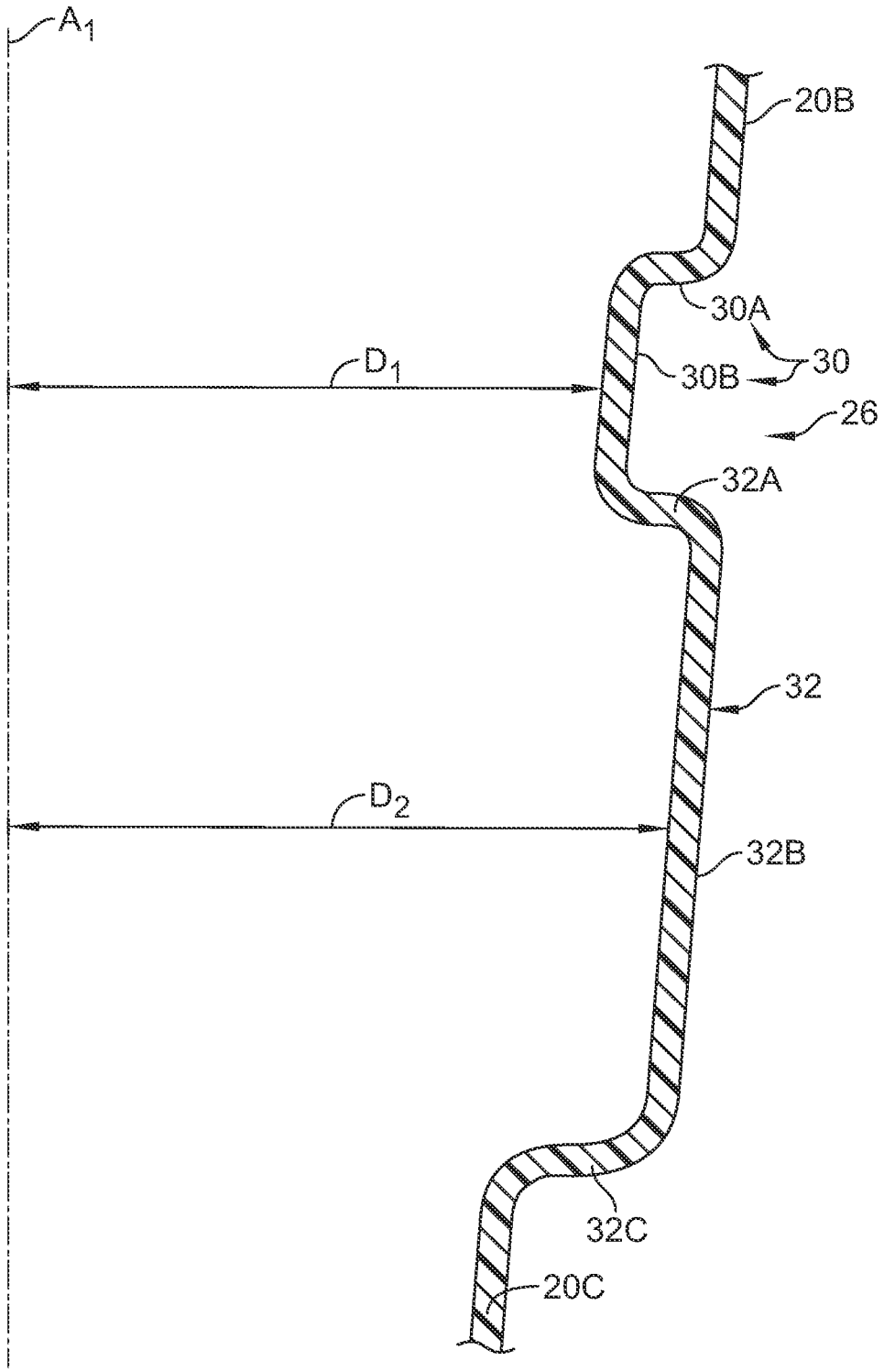
Figure 6:
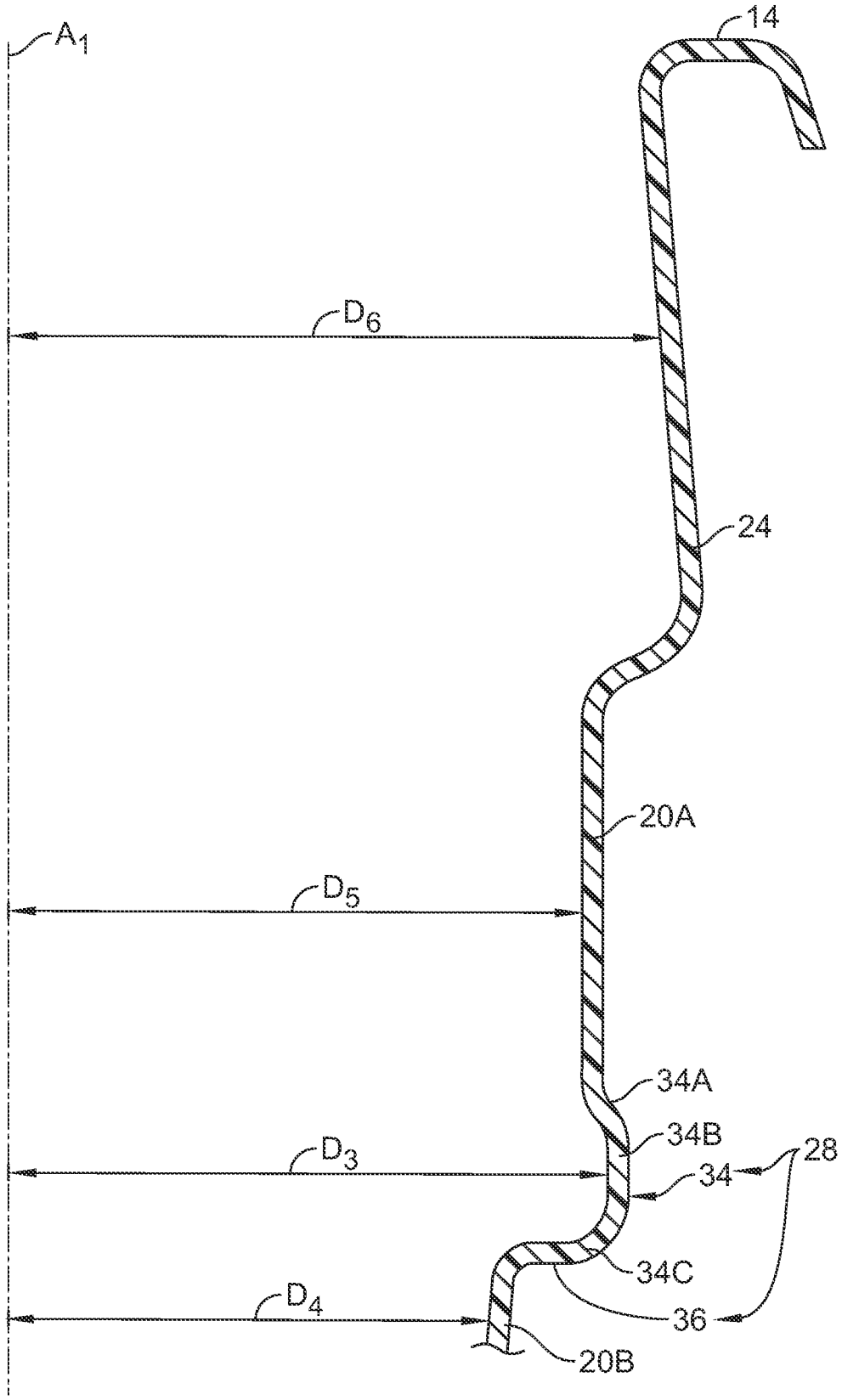

Body-strengthening system 16 includes a first strengthening unit 26 and a second strengthening unit 28, as shown in FIGS. 1-6. First strengthening unit 26 extends between and interconnects a middle portion 20B of side wall 20 and a lower portion 20C of side wall 20, as shown in FIGS. 2, 4, and 5. Second strengthening unit 28 extends between and interconnects an upper portion 20A of side wall 20 and middle portion 20B as shown in FIGS. 3, 4, and 6. First strengthening unit 26 and second strengthening unit 28 cooperate to increase rigidity for a portion of side wall 20.

First strengthening unit 26 includes an upper-strengthening segment 30 and a C-shaped strengthening segment 32, as shown in FIG. 5. Upper-strengthening segment 30 extends between and interconnects middle portion 20B of side wall 20 and C-shaped strengthening segment 32. C-shaped strengthening segment 32 extends between and interconnects upper-strengthening segment 30 and lower portion 20C of side wall 20.

Upper-strengthening segment 30 includes an annular strip 30A and an annular band 30B, as shown in FIG. 5. Annular strip 30A extends between and interconnects middle portion 20B of side wall 20 and annular band 30B. Annular band 30B is located a first distance D1 from central axis A1. Annular band 30B extends between and interconnects annular strip 30A with C-shaped strengthening segment 32.

C-shaped strengthening segment 32 includes a first annular strip 32A, a second annular strip 32C, and an annular band 32B, as shown in FIG. 5. First annular strip 32A extends between and interconnects upper-strengthening segment and annular band 32B. Second annular strip 32C extends between and interconnects lower portion 20C of side wall 20 and annular band 32B. Annular band 32B is located between first annular strip 32A and second annular strip 32C. Annular band 32B is located a second distance D2 from central axis A1. Second distance D2 is generally greater than the first distance D1 from annular band 30B of upper-strengthening segment 39 to central axis A1.

Second strengthening unit 28 includes a C-shaped annular ring 34 and an annular bottom strip 36, as shown in FIG. 6. C-shaped annular ring 34 extends between and interconnects annular bottom strip 36 and upper portion 20A of side wall 20. Annular bottom strip 36 extends between and interconnects C-shaped annular ring 34 and middle portion 20B of side wall 20.

C-shaped annular ring 34 includes a first annular strip 34A, a second annular strip 34C, and an annular band 34B, as shown in FIG. 6. First annular strip 34A extends between and interconnects upper portion 20A of side wall 20 and annular band 34B. Second annular strip 34C extends between and interconnects annular bottom strip 36 and annular band 34B. Annular band 34B extends between and interconnects first annular strip 34A and second annular strip 34C. Annular band 34B is located a third distance D3 from central axis A1. Third distance D3 is generally less than a fourth distance D4 located between middle portion 20B of side wall 20 and a fifth distance D5 located between central axis A1 and upper portion 20A of side wall 20.

In one example, the side wall of the drink cup has a frustoconical shape. Each of the first and second strengthening units is coupled to the side wall and are arranged to deviate from the frustoconical shape of the side wall. In one example, the first and second strengthening units extend away from the side wall toward, away from, or combinations thereof the central axis. Each of the first and second strengthening units can be seen a deviation or interruption of the frustoconical shape of the side wall.

In another embodiment, body-strengthening system 16 is configured to rigidify side wall 20 of drink cup 10. Body-strengthening system 16 is coupled to body 12 to minimize unintended deformation of side wall 20. In an example, body-strengthening system 16 in accordance with the present disclosure is configured to rigidify a cup 10, a container 10, or any other suitable alternative.

In one example, a drink cup in accordance with the present disclosure made from a formulation which is blended together and extruded into a sheet. The sheet is then formed into drink cups, for example, by a thermoforming process. In one example, the formulation comprises polypropylene. In another example, the formulation comprises polystyrene, polyethylene terephthalate, expanded polystyrene, polypropylene, polyethylene, suitable alternatives, and combinations thereof. In another example, the formulation further comprises an additive. Exemplary additives include, clarifiers, process aids, slip agents, mineral fillers, combinations thereof, or any suitable material for improving the drink cup. In some embodiments, the additive is a clarifier. In some embodiments, the additive is a copolymer. In some embodiments, the copolymer is an ethylene-polypropylene copolymer. In some embodiments, non-perforated cover 68 comprises Braskem RP650.

In one example, the formulation comprises a first polypropylene resin which is a homopolymer polypropylene resin. In another example, the formulation includes a first polypropylene resin and a second polypropylene resin. The first polypropylene resin may be an impact polypropylene copolymer and the second polypropylene resin may be an impact polypropylene copolymer including a mineral. The first polypropylene resin may be an impact polypropylene copolymer and the second polypropylene resin may be an impact polypropylene copolymer including calcium carbonate. The first polypropylene resin may be a polypropylene homopolymer and the second polypropylene resin may be an impact polypropylene copolymer.

Figure 7:
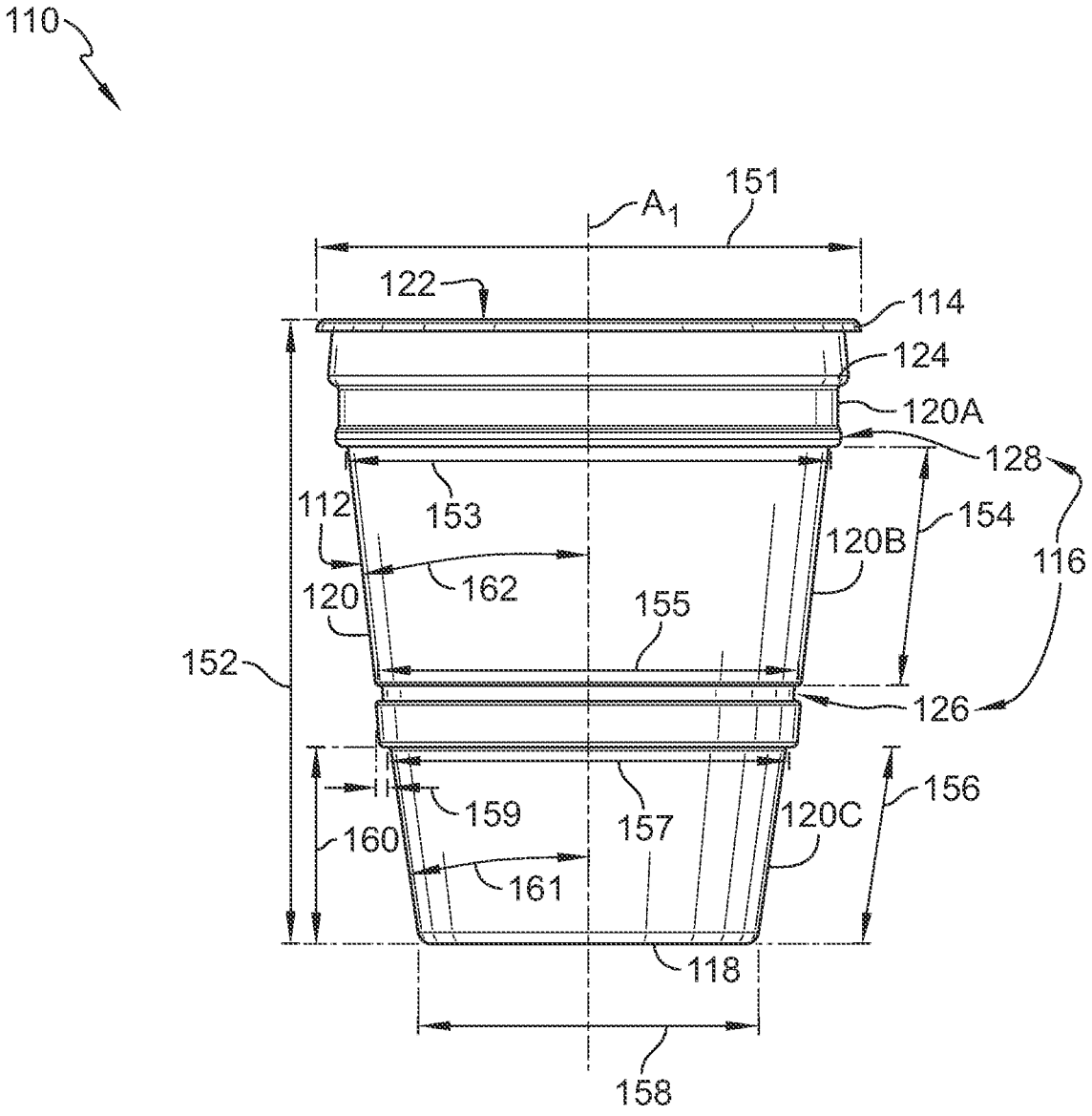
FIG. 7 is a side-elevation view another embodiment of a drink cup in accordance with the present disclosure.

Another embodiment of a drink cup 110 in accordance with the present disclosure is shown in FIG. 7. Drink cup 110 includes a body 112, a brim 114, and a body-strengthening system 116. Body-strengthening system 116 is coupled to body 112 between floor 118 and brim 114 and is configured to provide means for minimizing a weight of drink cup 110 while maximizing the rigidity of a selected portion of drink cup 110 so that unintended deformation of drink cup 110 is minimized.

Body 112 includes floor 118, side wall 120, and stack shoulder 124 as shown in FIG. 7. Floor 118 cooperates with side wall 120 to define interior region 122 to hold fluid therein. Side wall 120 extends away from floor 118 towards brim 114 along a central axis A1 as shown in FIG. 7. Stack shoulder 124 extends between and interconnects side wall 120 and brim 114, as shown in FIG. 7.

Body-strengthening system 116 includes a first strengthening unit 126 and a second strengthening unit 128, as shown in FIG. 7. First strengthening unit 126 extends between and interconnects a middle portion 120B of side wall 120 and a lower portion 120C of side wall 120, as shown in FIG. 7. Second strengthening unit 126 extends between and interconnects an upper portion 120A of side wall 120 and middle portion 120B as shown in FIG. 7. First strengthening unit 126 and second strengthening unit 128 cooperate to increase rigidity for a portion of side wall 120.

TABLE 1

| Dimensions of drink cup 110. | |
|---|---|
| Dimension | Measurement |
| 151 | 4.1" |
| 152 | 4.8" |

TABLE 1-continued

| Dimensions of drink cup 110. | |
|---|---|
| Dimension | Measurement |
| 153 | 3.6" |
| 154 | 1.8" |
| 155 | 3.3" |
| 156 | 1.4" |
| 157 | 3.0" |
| 158 | 2.6" |
| 159 | 0.1" |
| 160 | 1.5" |
| 161 | 8° |
| 162 | 6° |

*all dimensions are approximate

Figure 8:
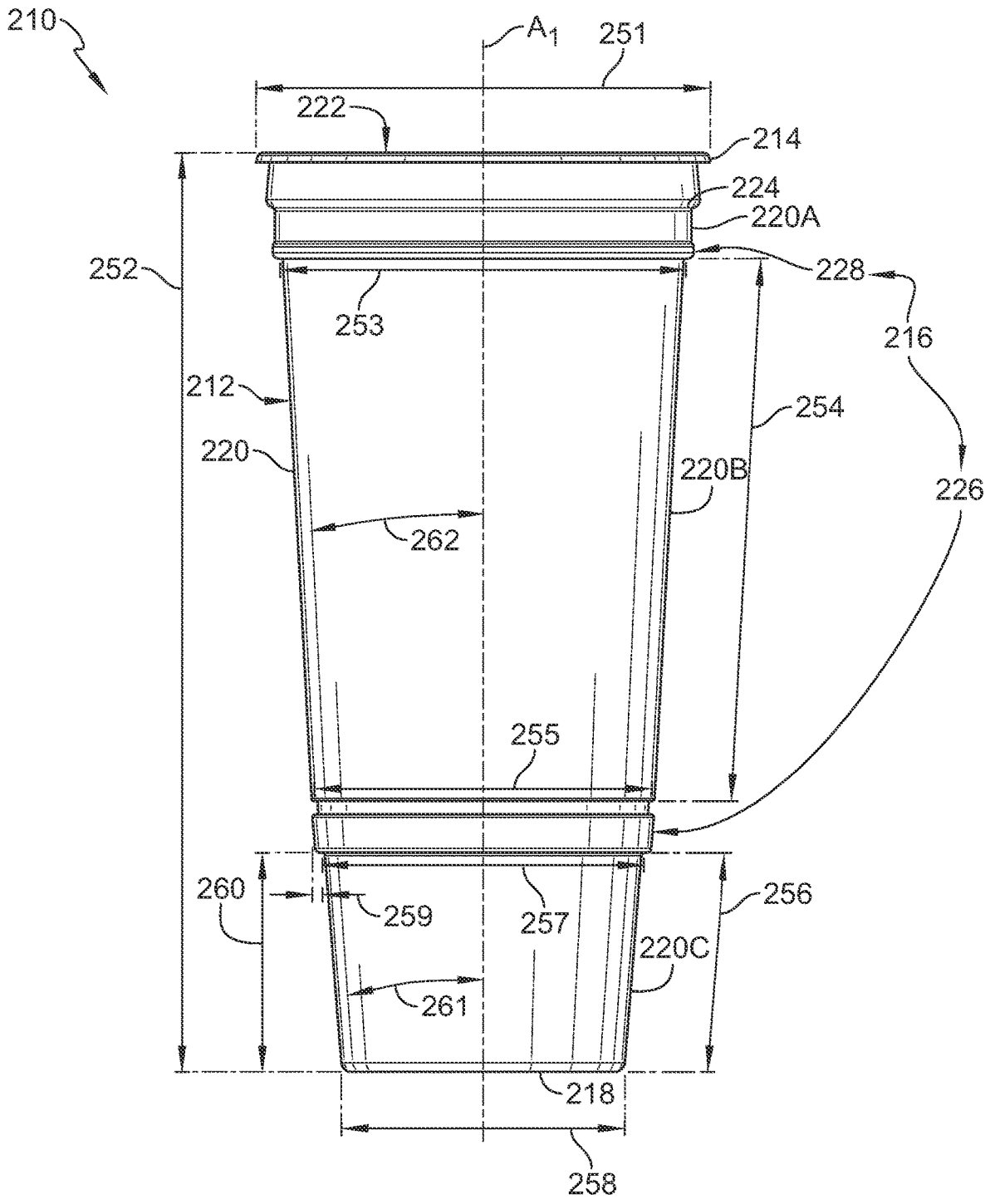
FIG. 8 is a side-elevation view another embodiment of a drink cup in accordance with the present disclosure.

Another embodiment of a drink cup 210 in accordance with the present disclosure is shown in FIG. 8. Drink cup 210 includes a body 212, a brim 214, and a body-strengthening system 216. Body-strengthening system 216 is coupled to body 212 between floor 218 and brim 214 and is configured to provide means for minimizing a weight of drink cup 210 while maximizing the rigidity of a selected portion of drink cup 210 so that unintended deformation of drink cup 210 is minimized.

Body 212 includes floor 218, side wall 220, and stack shoulder 224 as shown in FIG. 8. Floor 218 cooperates with side wall 220 to define interior region 222 to hold fluid therein. Side wall 220 extends away from floor 218 towards brim 214 along central axis A1 as shown in FIG. 8. Stack shoulder 224 extends between and interconnects side wall 220 and brim 214, as shown in FIG. 8.

Body-strengthening system 216 includes a first strengthening unit 226 and a second strengthening unit 228, as shown in FIG. 8. First strengthening unit 226 extends between and interconnects a middle portion 220B of side wall 220 and a lower portion 220C of side wall 220, as shown in FIG. 8. Second strengthening unit 228 extends between and interconnects an upper portion 220A of side wall 220 and middle portion 220B as shown in FIG. 8. First strengthening unit 226 and second strengthening unit 228 cooperate to increase rigidity for a portion of side wall 220.

TABLE 2

| Dimensions of drink cup 210. | |
|---|---|
| Dimension | Measurement |
| 251 | 4.1" |
| 252 | 6.8" |
| 253 | 3.6" |
| 254 | 3.3" |
| 255 | 3.1" |
| 256 | 1.9" |
| 257 | 2.9" |
| 258 | 2.6" |
| 259 | 0.1" |
| 260 | 2.0" |
| 261 | 4.5° |
| 262 | 4.5° |

Figure 9:
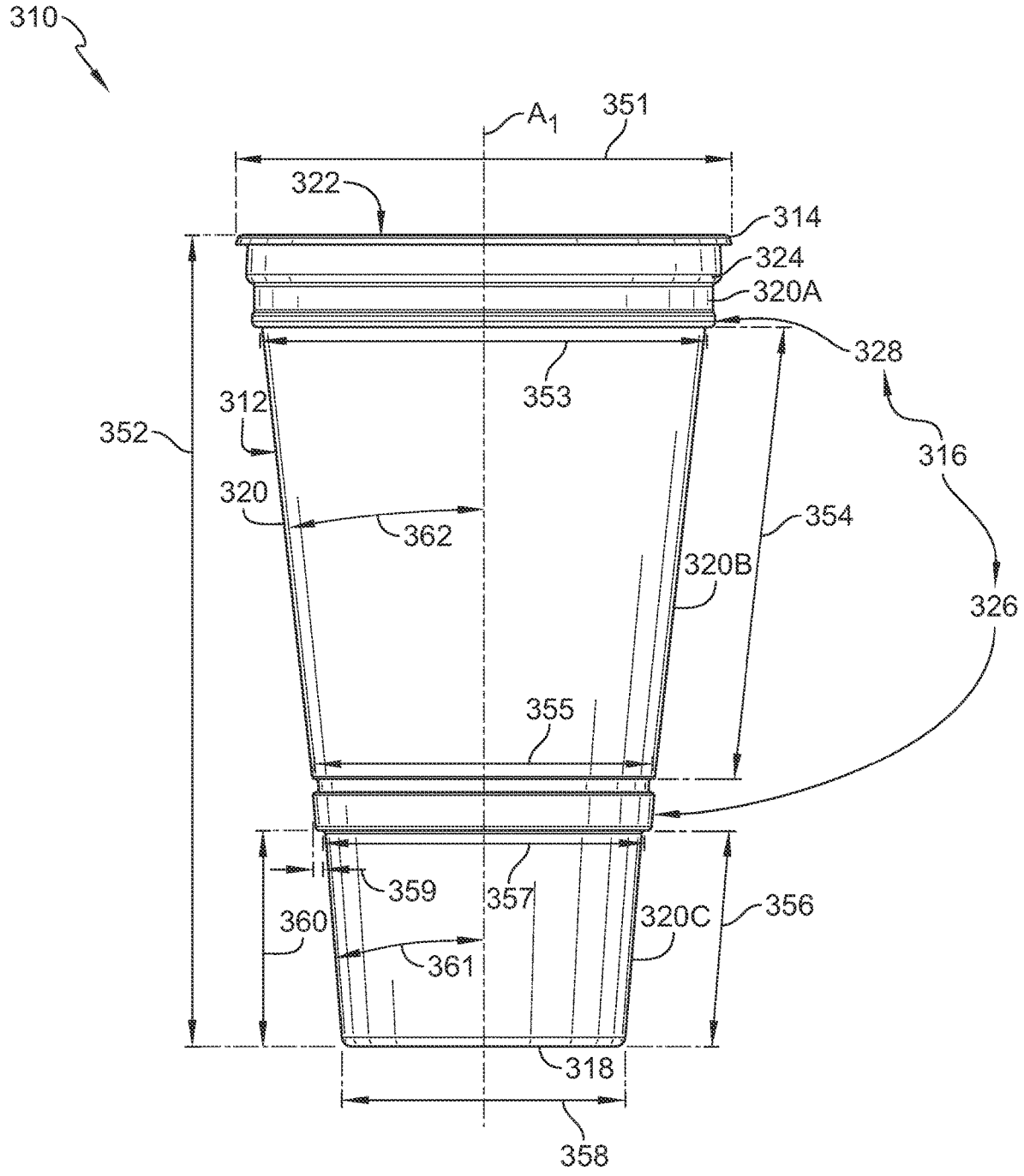
FIG. 9 is a side-elevation view another embodiment of a drink cup in accordance with the present disclosure.

Another embodiment of a drink cup 310 in accordance with the present disclosure is shown in FIG. 9. Drink cup 310 includes a body 312, a brim 314, and a body-strengthening system 316. Body-strengthening system 316 is coupled to body 312 between floor 318 and brim 314 and is configured to provide means for minimizing a weight of drink cup 310 while maximizing the rigidity of a selected portion of drink cup 310 so that unintended deformation of drink cup 310 is minimized.

Body 312 includes floor 318, side wall 320, and stack shoulder 324 as shown in FIG. 9. Floor 318 cooperates with side wall 320 to define interior region 322 to hold fluid therein. Side wall 320 extends away from floor 318 towards brim 314 along central axis A1 as shown in FIG. 9. Stack shoulder 324 extends between and interconnects side wall 320 and brim 314, as shown in FIG. 9.

Body-strengthening system 316 includes a first strengthening unit 326 and a second strengthening unit 328, as shown in FIG. 9. First strengthening unit 326 extends between and interconnects a middle portion 320B of side wall 320 and a lower portion 320C of side wall 320, as shown in FIG. 9. Second strengthening unit 328 extends between and interconnects an upper portion 320A of side wall 320 and middle portion 320B as shown in FIG. 9. First strengthening unit 326 and second strengthening unit 328 cooperate to increase rigidity for a portion of side wall 320.

TABLE 3

Dimensions of drink cup 310.

| Dimension | Measurement |
|---|---|
| 351 | 4.6" |
| 352 | 7.6" |
| 353 | 4.1" |
| 354 | 4.2" |
| 355 | 3.2" |
| 356 | 1.9" |
| 357 | 2.9" |
| 358 | 2.6" |
| 359 | 0.1" |
| 360 | 2.0" |
| 361 | 4.5° |
| 362 | 6.1° |

*all dimensions are approximate

Figure 10:
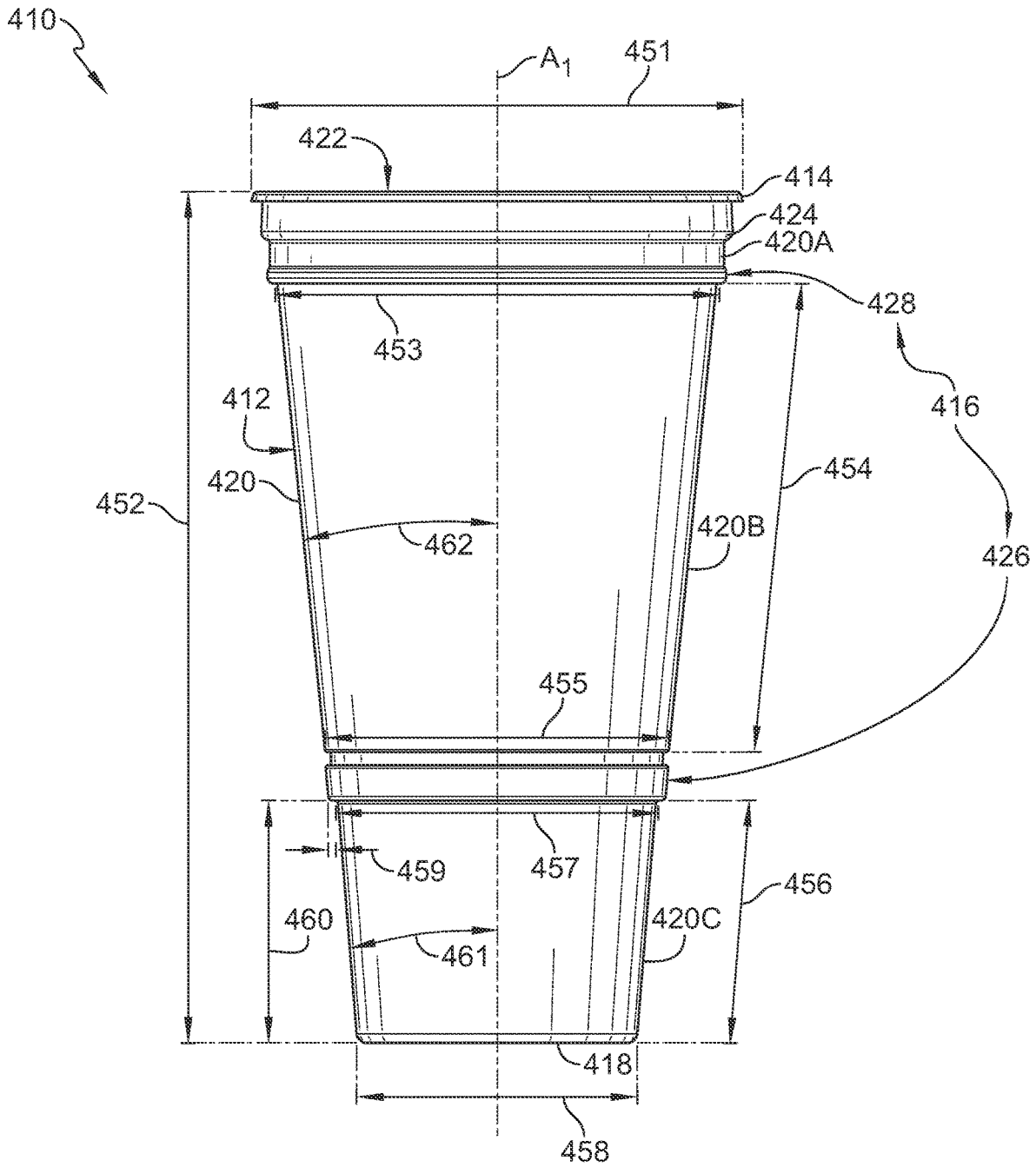
FIG. 10 is a side-elevation view another embodiment of a drink cup in accordance with the present disclosure.

Another embodiment of a drink cup 410 in accordance with the present disclosure is shown in FIG. 10. Drink cup 410 includes a body 412, a brim 414, and a body-strengthening system 416. Body-strengthening system 416 is coupled to body 412 between floor 418 and brim 414 and is configured to provide means for minimizing a weight of drink cup 410 while maximizing the rigidity of a selected portion of drink cup 410 so that unintended deformation of drink cup 410 is minimized.

Body 412 includes floor 418, side wall 420, and stack shoulder 424 as shown in FIG. 10. Floor 418 cooperates with side wall 420 to define interior region 422 to hold fluid therein. Side wall 420 extends away from floor 418 towards brim 414 along central axis A1 as shown in FIG. 10. Stack shoulder 424 extends between and interconnects side wall 420 and brim 414, as shown in FIG. 10.

Body-strengthening system 416 includes a first strengthening unit 426 and a second strengthening unit 428, as shown in FIG. 10. First strengthening unit 426 extends between and interconnects a middle portion 420B of side wall 420 and a lower portion 420C of side wall 420, as shown in FIG. 10. Second strengthening unit 428 extends between and interconnects an upper portion 420A of side wall 420 and middle portion 420B as shown in FIG. 10. First strengthening unit 426 and second strengthening unit 428 cooperate to increase rigidity for a portion of side wall 420.

TABLE 4

Dimensions of drink cup 410.

| Dimension | Measurement |
|---|---|
| 451 | 4.6" |
| 452 | 7.9" |
| 453 | 4.1" |
| 454 | 4.3" |
| 455 | 3.2" |
| 456 | 2.2" |
| 457 | 3.0" |
| 458 | 2.6" |
| 459 | 0.1" |
| 460 | 2.2" |
| 461 | 4.5° |
| 462 | 5.7° |

*all dimensions are approximate

Figure 11:
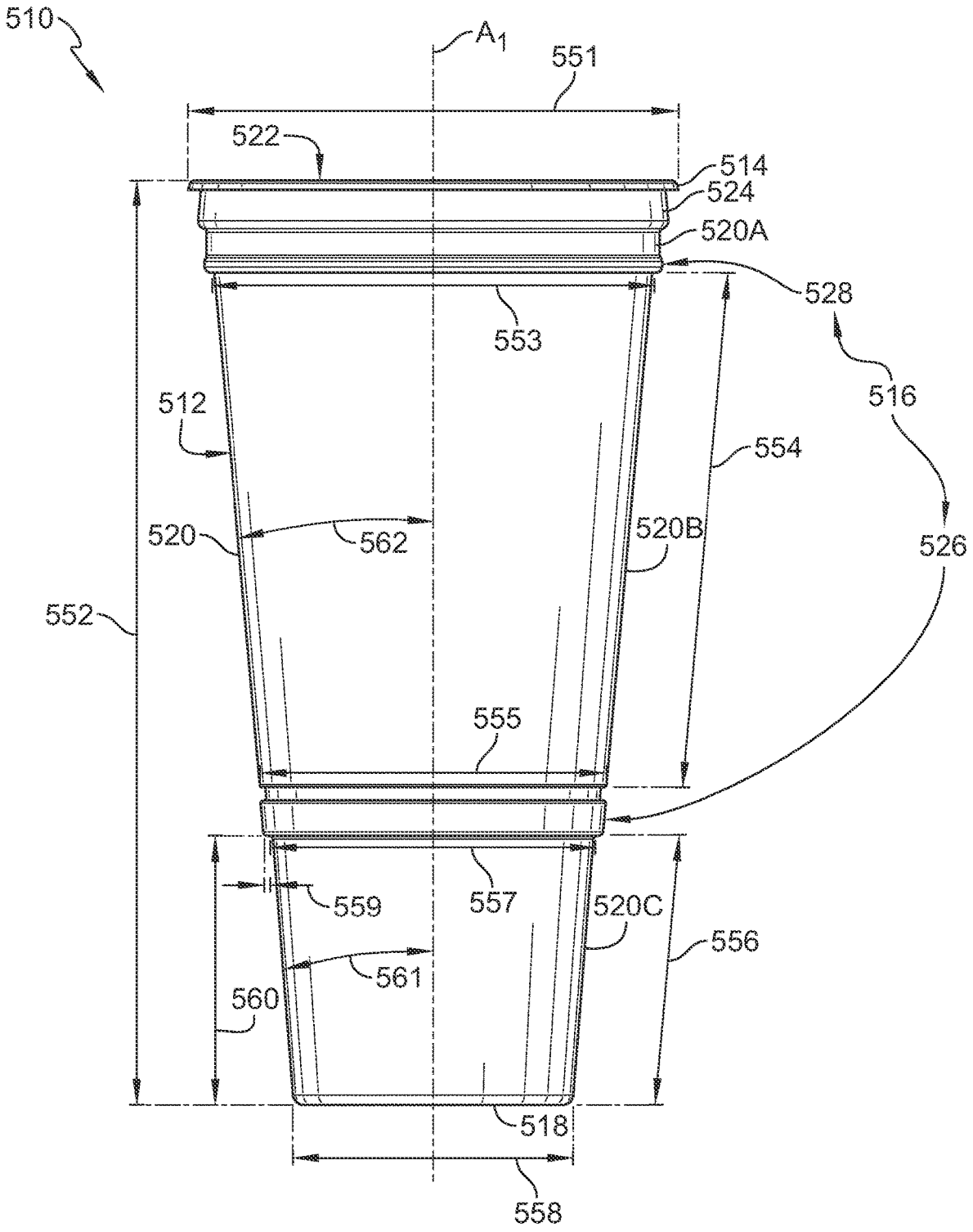
FIG. 11 is a side-elevation view another embodiment of a drink cup in accordance with the present disclosure.

Another embodiment of a drink cup 510 in accordance with the present disclosure is shown in FIG. 11. Drink cup 510 includes a body 512, a brim 514, and a body-strengthening system 516. Body-strengthening system 516 is coupled to body 512 between floor 518 and brim 514 and is configured to provide means for minimizing a weight of drink cup 510 while maximizing the rigidity of a selected portion of drink cup 510 so that unintended deformation of drink cup 510 is minimized.

Body 512 includes floor 518, side wall 520, and stack shoulder 524 as shown in FIG. 11. Floor 518 cooperates with side wall 520 to define interior region 522 to hold fluid therein. Side wall 520 extends away from floor 518 towards brim 514 along central axis A1 as shown in FIG. 11. Stack shoulder 524 extends between and interconnects side wall 520 and brim 514, as shown in FIG. 11.

Body-strengthening system 516 includes a first strengthening unit 526 and a second strengthening unit 528, as shown in FIG. 11. First strengthening unit 526 extends between and interconnects a middle portion 520B of side wall 520 and a lower portion 520C of side wall 520, as shown in FIG. 11. Second strengthening unit 528 extends between and interconnects an upper portion 520A of side wall 520 and middle portion 520B as shown in FIG. 11. First strengthening unit 526 and second strengthening unit 528 cooperate to increase rigidity for a portion of side wall 520.

TABLE 5

Dimensions of drink cup 510.

| Dimension | Measurement |
|---|---|
| 551 | 4.6" |
| 552 | 8.6" |
| 553 | 4.1" |
| 554 | 4.8" |
| 555 | 3.2" |
| 556 | 2.4" |
| 557 | 3.0" |
| 558 | 2.6" |
| 559 | 0.1" |
| 560 | 2.5" |
| 561 | 4.5° |
| 562 | 5.0° |

*all dimensions are approximate

Figure 12:
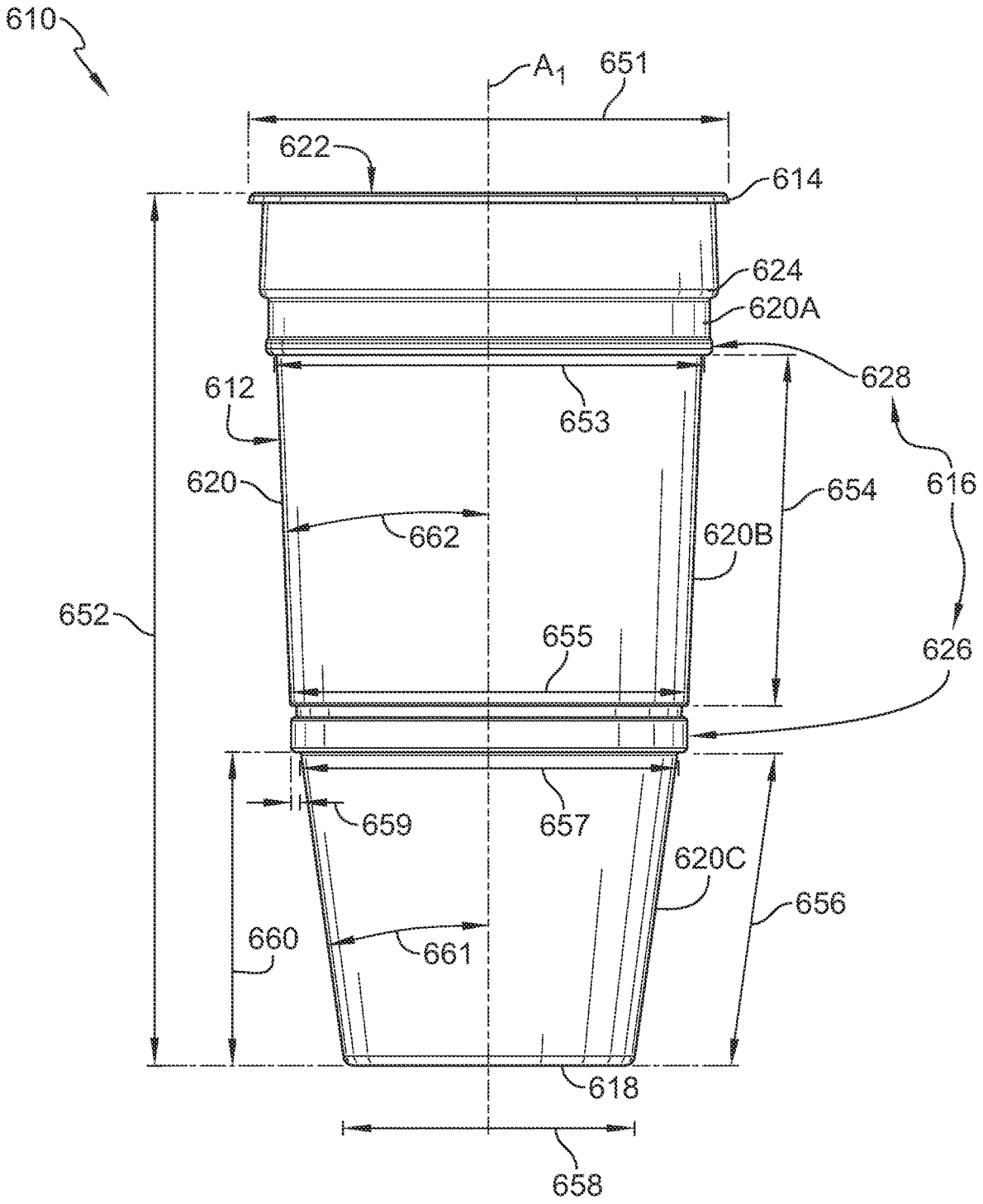
FIG. 12 is a side-elevation view another embodiment of a drink cup in accordance with the present disclosure.

Another embodiment of a drink cup 610 in accordance with the present disclosure is shown in FIG. 12. Drink cup 610 includes a body 612, a brim 614, and a body-strengthening system 616. Body-strengthening system 616 is coupled to body 612 between floor 618 and brim 614 and is configured to provide means for minimizing a weight of drink cup 610 while maximizing the rigidity of a selected portion of drink cup 610 so that unintended deformation of drink cup 610 is minimized.

Body 612 includes floor 618, side wall 620, and stack shoulder 624 as shown in FIG. 12. Floor 618 cooperates with side wall 620 to define interior region 622 to hold fluid therein. Side wall 620 extends away from floor 618 towards brim 614 along central axis A1 as shown in FIG. 12. Stack shoulder 624 extends between and interconnects side wall 620 and brim 614, as shown in FIG. 12.

Body-strengthening system 616 includes a first strengthening unit 626 and a second strengthening unit 628, as shown in FIG. 12. First strengthening unit 626 extends between and interconnects a middle portion 620B of side wall 620 and a lower portion 620C of side wall 620, as shown in FIG. 12. Second strengthening unit 628 extends between and interconnects an upper portion 620A of side wall 620 and middle portion 620B as shown in FIG. 12. First strengthening unit 626 and second strengthening unit 628 cooperate to increase rigidity for a portion of side wall 620.

TABLE 6

Dimensions of drink cup 610.

| Dimension | Measurement |
|---|---|
| 651 | 4.6" |
| 652 | 8.4" |
| 653 | 4.1" |
| 654 | 3.3" |
| 655 | 3.8" |
| 656 | 2.9" |
| 657 | 3.6" |
| 658 | 2.8" |
| 659 | 0.1" |
| 660 | 3.0" |
| 661 | 8.0° |
| 662 | 2.4° |

*all dimensions are approximate

Figure 13:
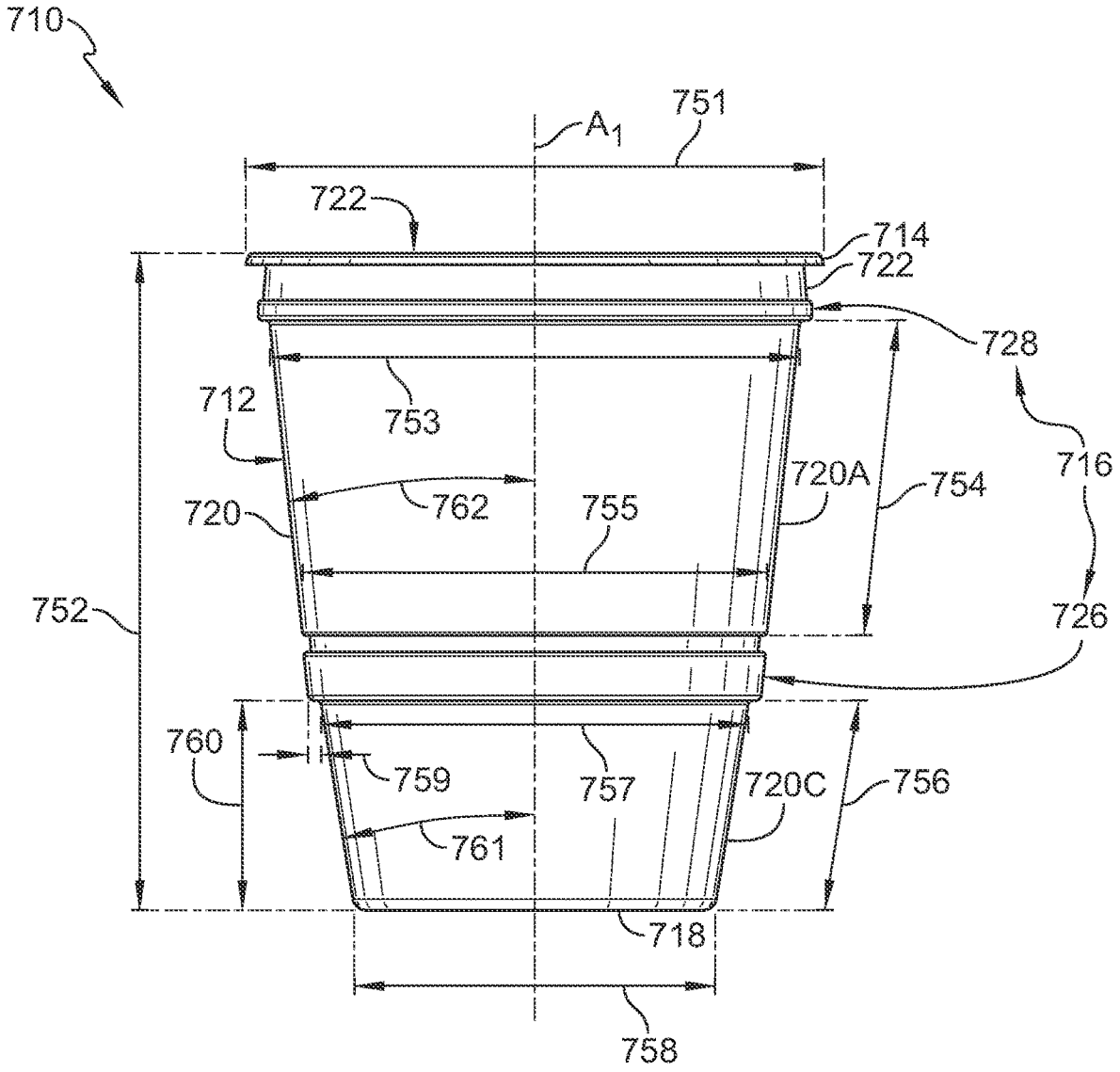
FIG. 13 is a side-elevation view another embodiment of a drink cup in accordance with the present disclosure.

Another embodiment of a drink cup 710 in accordance with the present disclosure is shown in FIG. 13. Drink cup 710 includes a body 712, a brim 714, and a body-strengthening system 716. Body-strengthening system 716 is coupled to body 712 between floor 718 and brim 714 and is configured to provide means for minimizing a weight of drink cup 710 while maximizing the rigidity of a selected portion of drink cup 710 so that unintended deformation of drink cup 710 is minimized.

Body 712 includes floor 718, side wall 720, and stack shoulder 724 as shown in FIG. 13. Floor 718 cooperates with side wall 720 to define interior region 722 to hold fluid therein. Side wall 720 extends away from floor 718 towards brim 714 along central axis A1 as shown in FIG. 13. Stack shoulder 724 extends between and interconnects side wall 720 and brim 714, as shown in FIG. 13.

Body-strengthening system 716 includes a first strengthening unit 726 and a second strengthening unit 728, as shown in FIG. 13. First strengthening unit 726 extends between and interconnects an upper portion 720A of side wall 720 and a lower portion 720C of side wall 720, as shown in FIG. 13. Second strengthening unit 728 extends between and interconnects an upper portion 720A of side wall 720 and stack shoulder 724 as shown in FIG. 13. First strengthening unit 726 and second strengthening unit 728 cooperate to increase rigidity for a portion of side wall 720.

TABLE 7

Dimensions of drink cup 710.

| Dimension | Measurement |
|---|---|
| 751 | 4.1" |
| 752 | — |
| 753 | 3.8" |
| 754 | 2.2" |
| 755 | 3.3" |
| 756 | 1.4" |
| 757 | 3.0" |
| 758 | 2.6" |
| 759 | 0.1" |
| 760 | 1.5" |
| 761 | 9.3° |
| 762 | 6.0° |

*all dimensions are approximate

Figure 14:
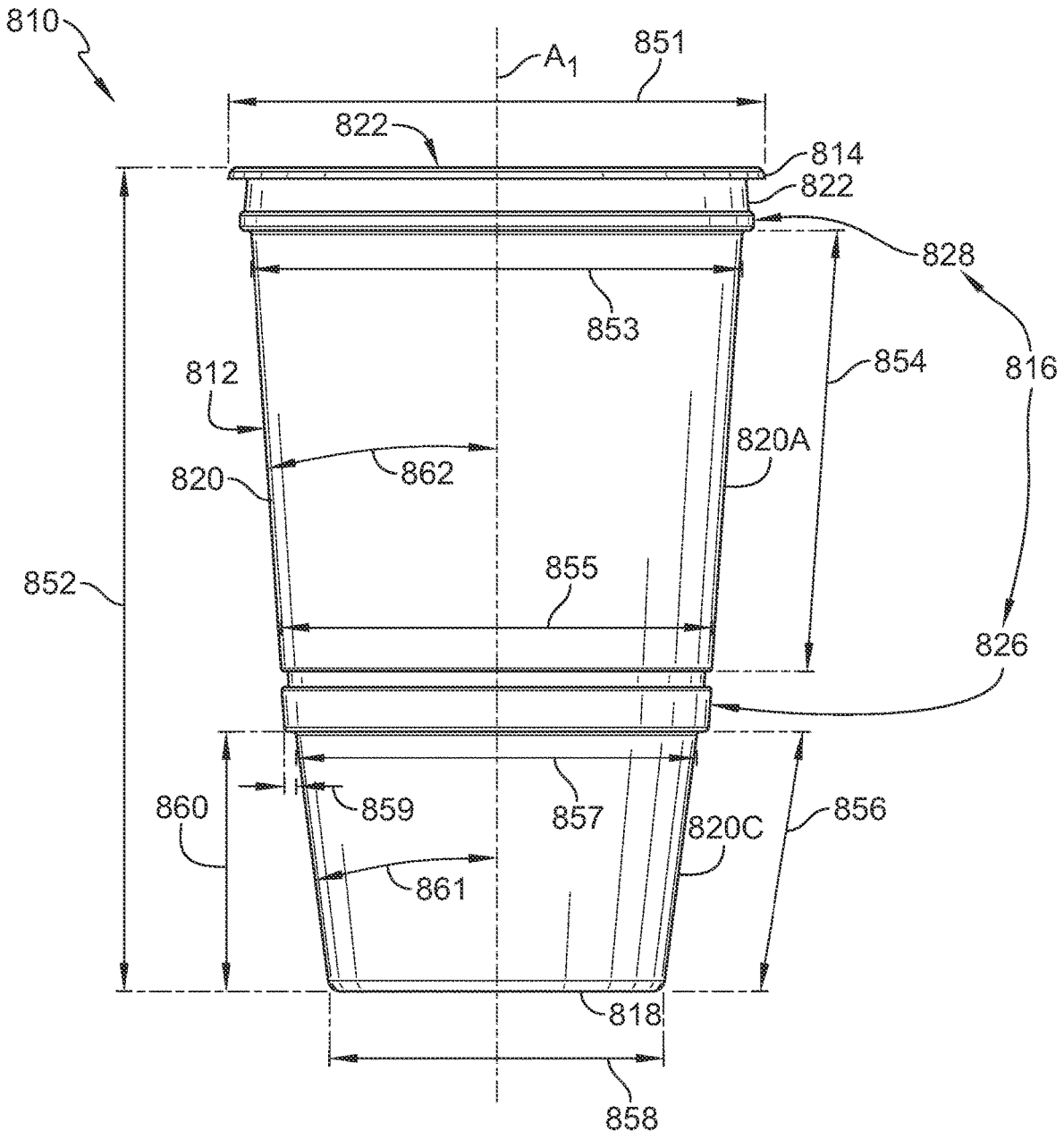
FIG. 14 is a side-elevation view another embodiment of a drink cup in accordance with the present disclosure.

Another embodiment of a drink cup 810 in accordance with the present disclosure is shown in FIG. 14. Drink cup 810 includes a body 812, a brim 814, and a body-strengthening system 816. Body-strengthening system 816 is coupled to body 812 between floor 818 and brim 814 and is configured to provide means for minimizing a weight of drink cup 810 while maximizing the rigidity of a selected portion of drink cup 810 so that unintended deformation of drink cup 810 is minimized.

Body 812 includes floor 818, side wall 820, and stack shoulder 824 as shown in FIG. 14. Floor 818 cooperates with side wall 820 to define interior region 822 to hold fluid therein. Side wall 820 extends away from floor 818 towards brim 814 along central axis A1 as shown in FIG. 14. Stack shoulder 824 extends between and interconnects side wall 820 and brim 814, as shown in FIG. 14.

Body-strengthening system 816 includes a first strengthening unit 826 and a second strengthening unit 828, as shown in FIG. 14. First strengthening unit 826 extends between and interconnects an upper portion 820A of side wall 820 and a lower portion 820C of side wall 820, as shown in FIG. 14. Second strengthening unit 828 extends between and interconnects an upper portion 820A of side wall 820 and stack shoulder 824 as shown in FIG. 14. First strengthening unit 826 and second strengthening unit 828 cooperate to increase rigidity for a portion of side wall 820.

TABLE 8

Dimensions of drink cup 810.

| Dimension | Measurement |
|---|---|
| 851 | 4.1" |
| 852 | 6.4" |
| 853 | 3.8" |
| 854 | 3.4" |
| 855 | 3.3" |
| 856 | 1.9" |
| 857 | 3.1" |
| 858 | 2.6" |
| 859 | 0.1" |
| 860 | 2.0" |
| 861 | 7.4° |
| 862 | 4.0° |

*all dimensions are approximate

Figure 15:
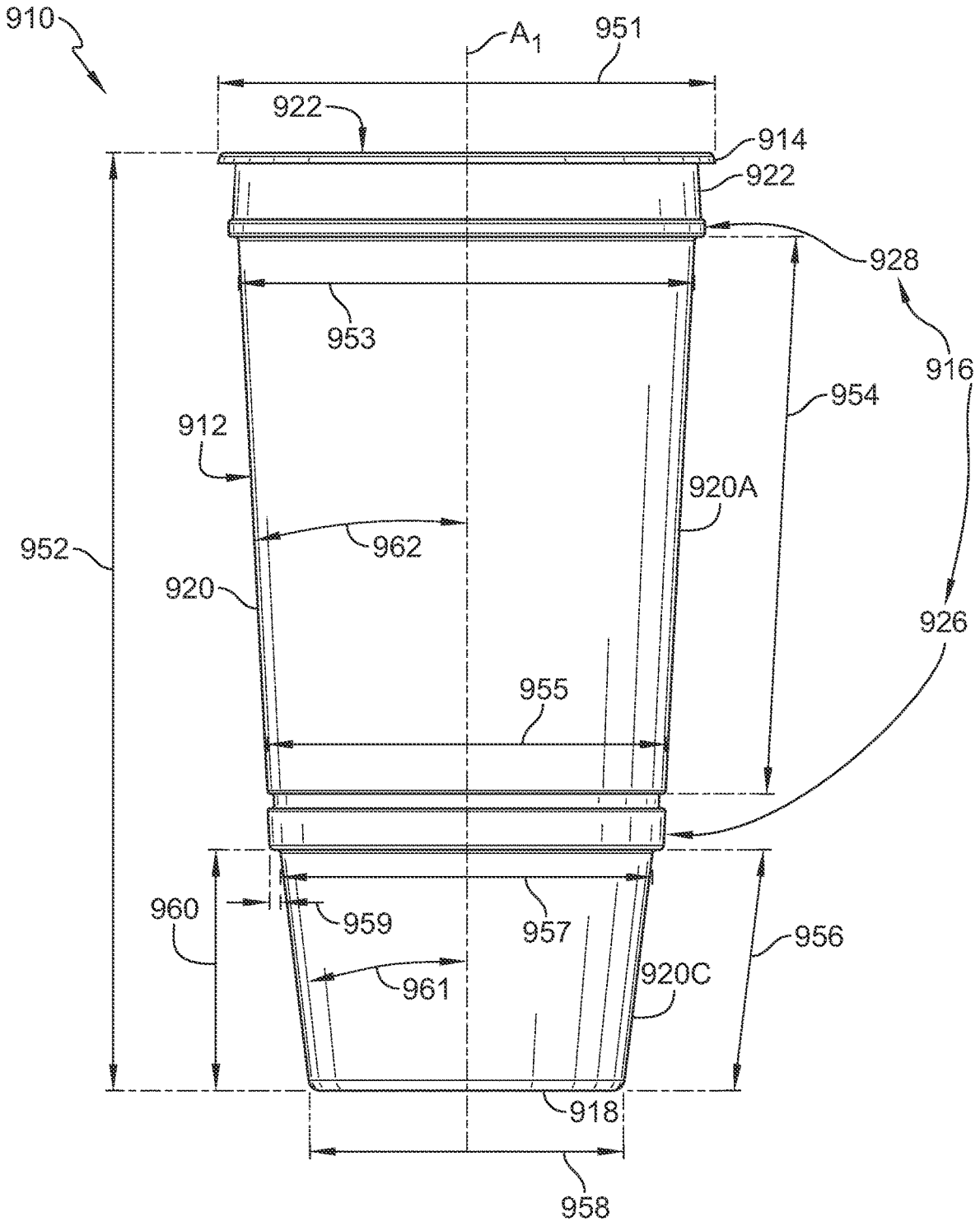
FIG. 15 is a side-elevation view another embodiment of a drink cup in accordance with the present disclosure.

Another embodiment of a drink cup 910 in accordance with the present disclosure is shown in FIG. 15. Drink cup 910 includes a body 912, a brim 914, and a body-strengthening system 916. Body-strengthening system 916 is coupled to body 912 between floor 918 and brim 914 and is configured to provide means for minimizing a weight of drink cup 910 while maximizing the rigidity of a selected portion of drink cup 910 so that unintended deformation of drink cup 910 is minimized.

Body 912 includes floor 918, side wall 920, and stack shoulder 924 as shown in FIG. 15. Floor 918 cooperates with side wall 920 to define interior region 922 to hold fluid therein. Side wall 920 extends away from floor 918 towards brim 914 along central axis A1 as shown in FIG. 15. Stack shoulder 924 extends between and interconnects side wall 920 and brim 914, as shown in FIG. 15.

Body-strengthening system 916 includes a first strengthening unit 926 and a second strengthening unit 928, as shown in FIG. 15. First strengthening unit 926 extends between and interconnects an upper portion 920A of side wall 920 and a lower portion 920C of side wall 920, as shown in FIG. 15. Second strengthening unit 928 extends between and interconnects an upper portion 920A of side wall 920 and stack shoulder 924 as shown in FIG. 15. First strengthening unit 926 and second strengthening unit 928 cooperate to increase rigidity for a portion of side wall 920.

TABLE 9

Dimensions of drink cup 910.

| Dimension | Measurement |
|---|---|
| 951 | 4.1" |
| 952 | 7.8" |
| 953 | 3.8" |
| 954 | 4.6" |
| 955 | 3.3" |
| 956 | 1.9" |
| 957 | 3.1" |
| 958 | 2.6" |
| 959 | 0.1" |
| 960 | 2.0" |
| 961 | 7.0° |
| 962 | 3.0° |

*all dimensions are approximate

Figure 16:
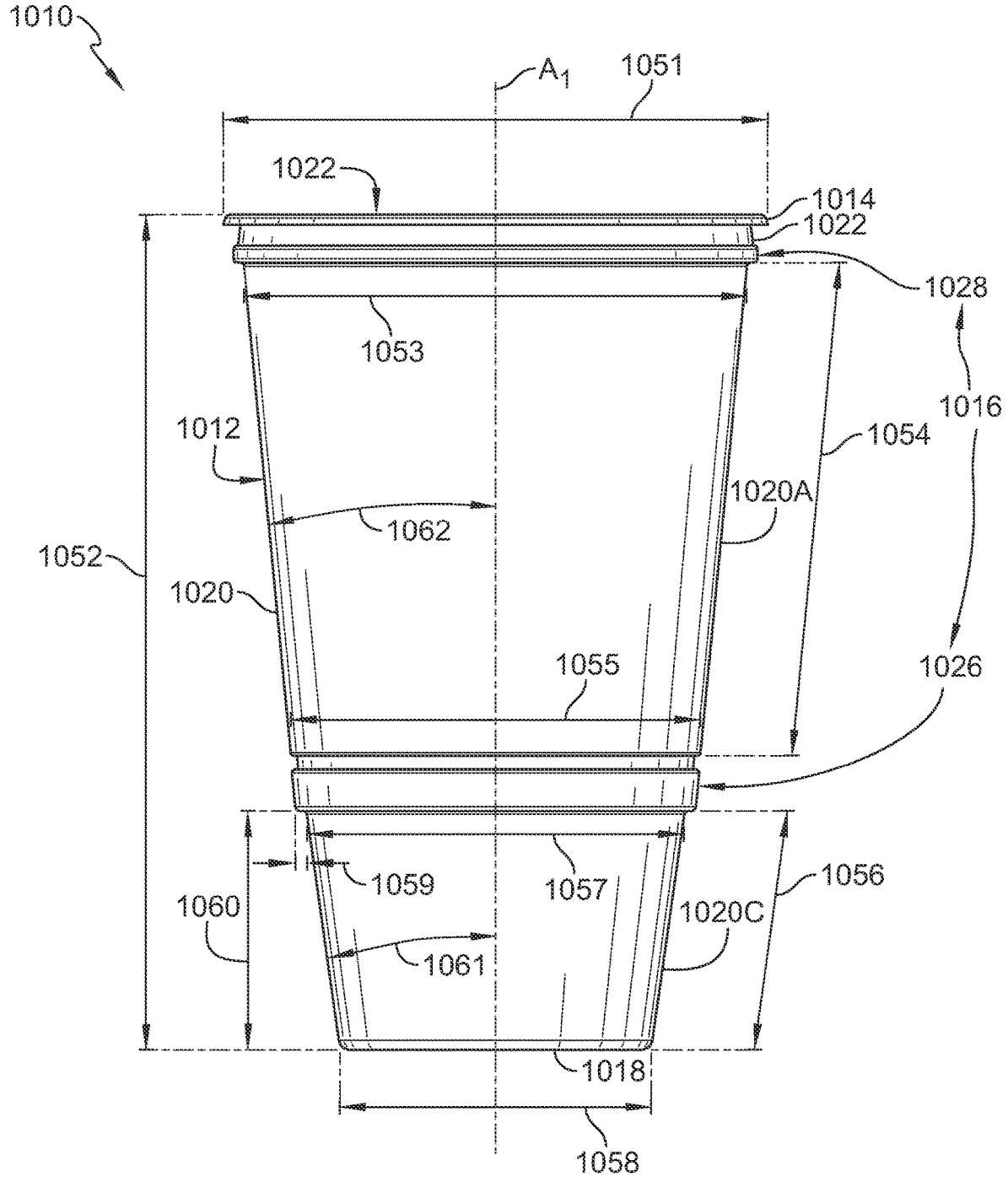
FIG. 16 is a side-elevation view another embodiment of a drink cup in accordance with the present disclosure.

Another embodiment of a drink cup 1010 in accordance with the present disclosure is shown in FIG. 16. Drink cup 1010 includes a body 1012, a brim 1014, and a body-strengthening system 1016. Body-strengthening system 1016 is coupled to body 1012 between floor 1018 and brim 1014 and is configured to provide means for minimizing a weight of drink cup 1010 while maximizing the rigidity of a selected portion of drink cup 1010 so that unintended deformation of drink cup 1010 is minimized.

Body 1012 includes floor 1018, side wall 1020, and stack shoulder 1024 as shown in FIG. 16. Floor 1018 cooperates with side wall 1020 to define interior region 1022 to hold fluid therein. Side wall 1020 extends away from floor 1018 towards brim 1014 along central axis A1 as shown in FIG. 16. Stack shoulder 1024 extends between and interconnects side wall 1020 and brim 1014, as shown in FIG. 16.

Body-strengthening system 1016 includes a first strengthening unit 1026 and a second strengthening unit 1028, as shown in FIG. 16. First strengthening unit 1026 extends between and interconnects an upper portion 1020A of side wall 1020 and a lower portion 1020C of side wall 1020, as shown in FIG. 16. Second strengthening unit 1028 extends between and interconnects an upper portion 1020A of side wall 1020 and stack shoulder 1024 as shown in FIG. 16. First strengthening unit 1026 and second strengthening unit 1028 cooperate to increase rigidity for a portion of side wall 1020.

TABLE 10

Dimensions of drink cup 1010.

| Dimension | Measurement |
|---|---|
| 1051 | 4.6" |
| 1052 | 7.0" |
| 1053 | 4.2" |
| 1054 | 4.1" |
| 1055 | 3.4" |
| 1056 | 1.9" |
| 1057 | 3.2" |
| 1058 | 2.6" |
| 1059 | 0.1" |
| 1060 | 2.0" |
| 1061 | 8.0° |
| 1062 | 5.5° |

*all dimensions are approximate

Figure 17:
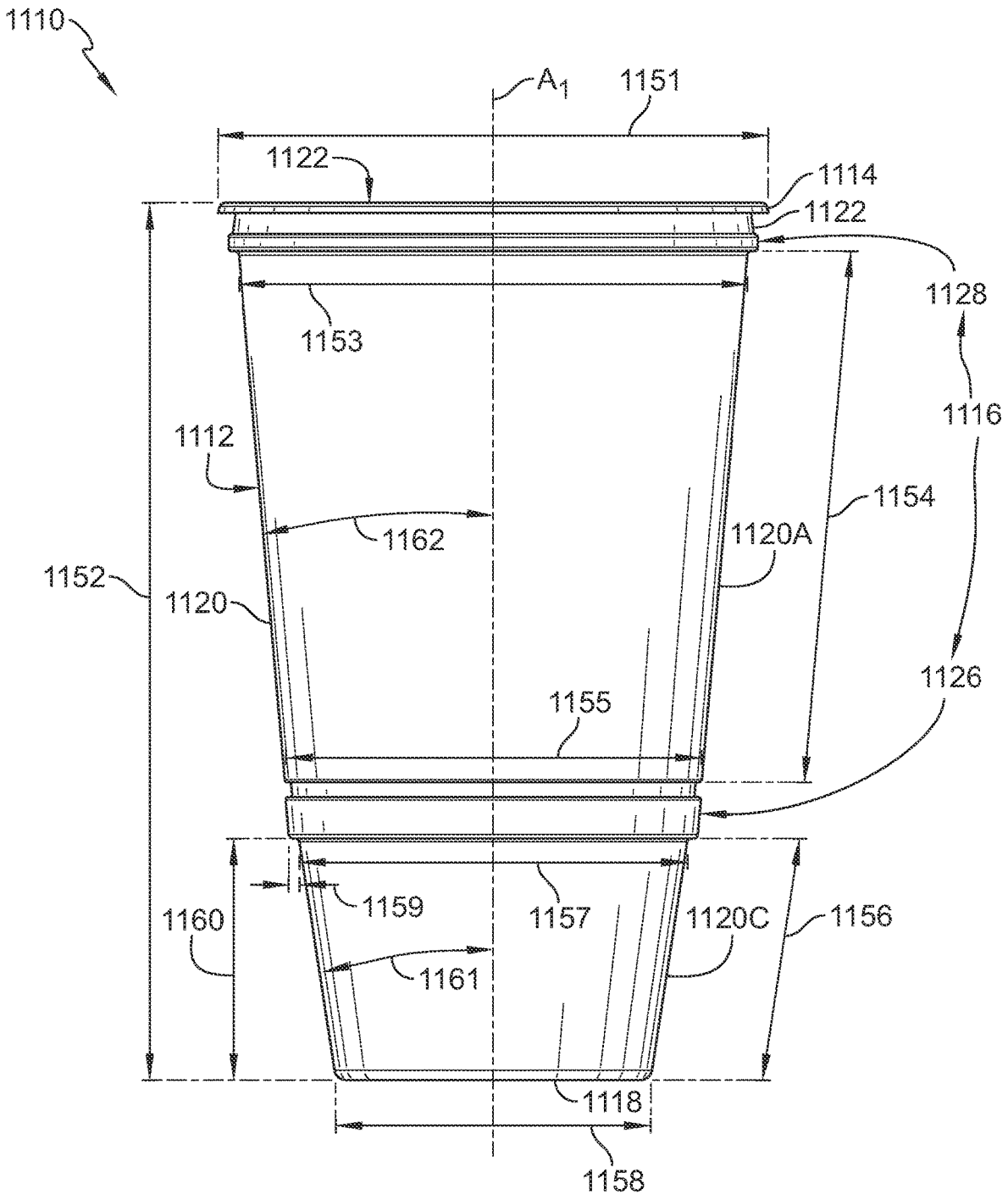
FIG. 17 is a side-elevation view another embodiment of a drink cup in accordance with the present disclosure.

Another embodiment of a drink cup 1110 in accordance with the present disclosure is shown in FIG. 17. Drink cup 1110 includes a body 1112, a brim 1114, and a body-strengthening system 1116. Body-strengthening system 1116 is coupled to body 1112 between floor 1018 and brim 1114 and is configured to provide means for minimizing a weight of drink cup 1110 while maximizing the rigidity of a selected portion of drink cup 1110 so that unintended deformation of drink cup 1110 is minimized.

Body 1112 includes floor 1118, side wall 1120, and stack shoulder 1124 as shown in FIG. 17. Floor 1118 cooperates with side wall 1120 to define interior region 1122 to hold fluid therein. Side wall 1120 extends away from floor 11118 towards brim 1114 along central axis A1 as shown in FIG. 17. Stack shoulder 1124 extends between and interconnects side wall 1120 and brim 1114, as shown in FIG. 17.

Body-strengthening system 1116 includes a first strengthening unit 1126 and a second strengthening unit 1128, as shown in FIG. 17. First strengthening unit 1126 extends between and interconnects an upper portion 1120A of side wall 1120 and a lower portion 1120C of side wall 1120, as shown in FIG. 17. Second strengthening unit 1128 extends between and interconnects an upper portion 1120A of side wall 1120 and stack shoulder 1124 as shown in FIG. 17. First strengthening unit 1126 and second strengthening unit 1128 cooperate to increase rigidity for a portion of side wall 1120.

TABLE 11

Dimensions of drink cup 1110.

| Dimension | Measurement |
|---|---|
| 1151 | 4.6" |
| 1152 | 7.3" |
| 1153 | 4.2" |
| 1154 | 4.4" |
| 1155 | 3.4" |
| 1156 | 1.9" |
| 1157 | 3.6" |
| 1158 | 3.2" |
| 1159 | 0.1" |
| 1160 | 2.0" |
| 1161 | 8.8° |
| 1162 | 5.0° |

*all dimensions are approximate

Figure 18:
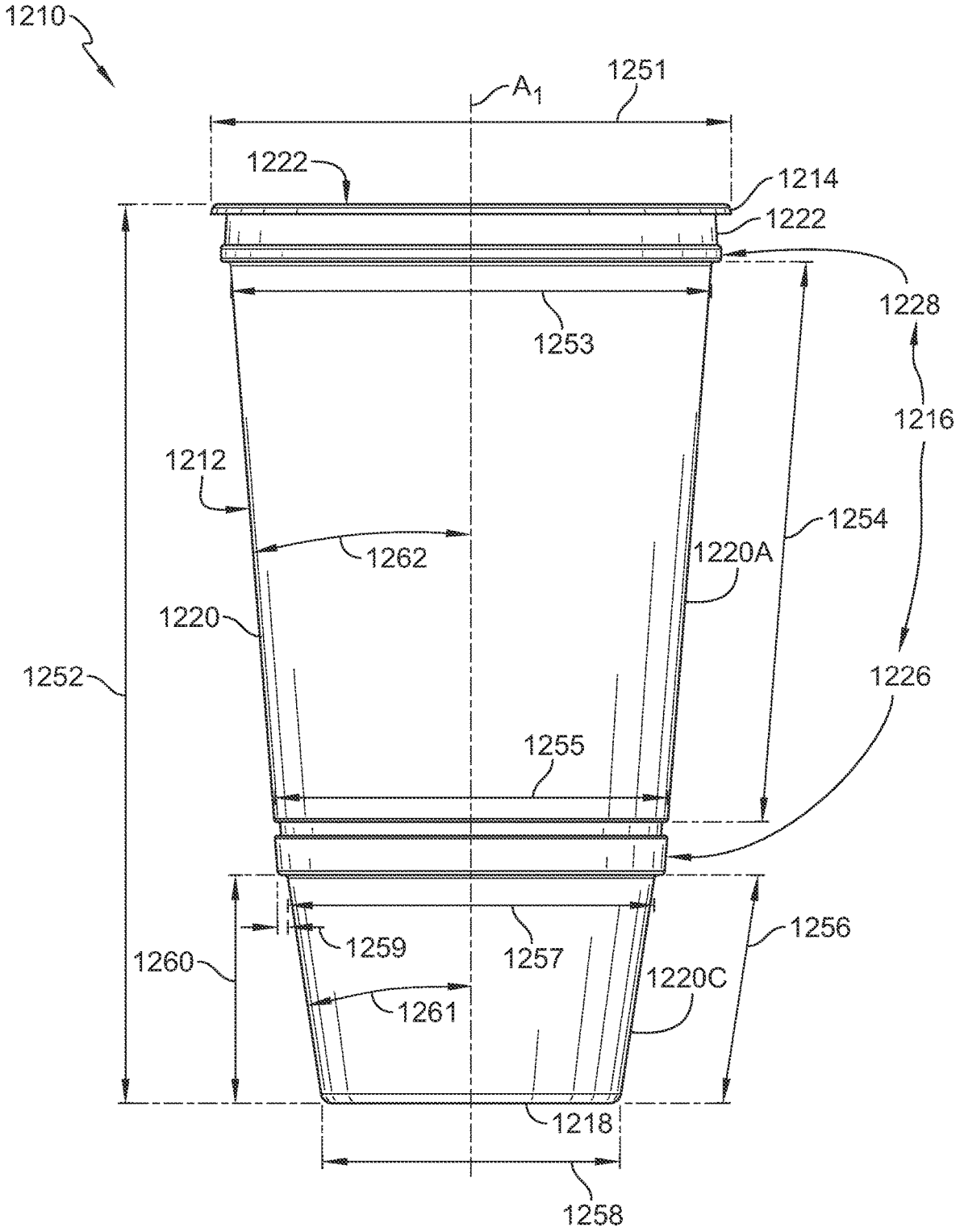
FIG. 18 is a side-elevation view of another embodiment of a drink cup in accordance with the present disclosure.

Another embodiment of a drink cup 1210 in accordance with the present disclosure is shown in FIG. 18. Drink cup 1210 includes a body 1212, a brim 1214, and a body-strengthening system 1216. Body-strengthening system 1216 is coupled to body 1212 between floor 1218 and brim 1214 and is configured to provide means for minimizing a weight of drink cup 1210 while maximizing the rigidity of a selected portion of drink cup 1210 so that unintended deformation of drink cup 1210 is minimized.

Body 1212 includes floor 1218, side wall 1220, and stack shoulder 1224 as shown in FIG. 18. Floor 1218 cooperates with side wall 1220 to define interior region 1222 to hold fluid therein. Side wall 1220 extends away from floor 1218 towards brim 1214 along central axis A1 as shown in FIG. 18. Stack shoulder 1224 extends between and interconnects side wall 1220 and brim 1214, as shown in FIG. 18.

Body-strengthening system 1216 includes a first strengthening unit 1226 and a second strengthening unit 1228, as shown in FIG. 18. First strengthening unit 1226 extends between and interconnects an upper portion 1220A of side wall 1220 and a lower portion 1220C of side wall 1220, as shown in FIG. 18. Second strengthening unit 1228 extends between and interconnects an upper portion 1220A of side wall 1220 and stack shoulder 1224 as shown in FIG. 18. First strengthening unit 1226 and second strengthening unit 1228 cooperate to increase rigidity for a portion of side wall 1220.

TABLE 12

Dimensions of drink cup 1210.

| Dimension | Measurement |
|---|---|
| 1251 | 4.6" |
| 1252 | 7.9" |
| 1253 | 4.2" |
| 1254 | 4.9" |
| 1255 | 3.4" |
| 1256 | 1.9" |
| 1257 | 3.2" |
| 1258 | 2.6" |
| 1259 | 0.1" |
| 1260 | 2.0" |
| 1261 | 8.8° |
| 1262 | 4.5° |

*all dimensions are approximate

Figure 19:
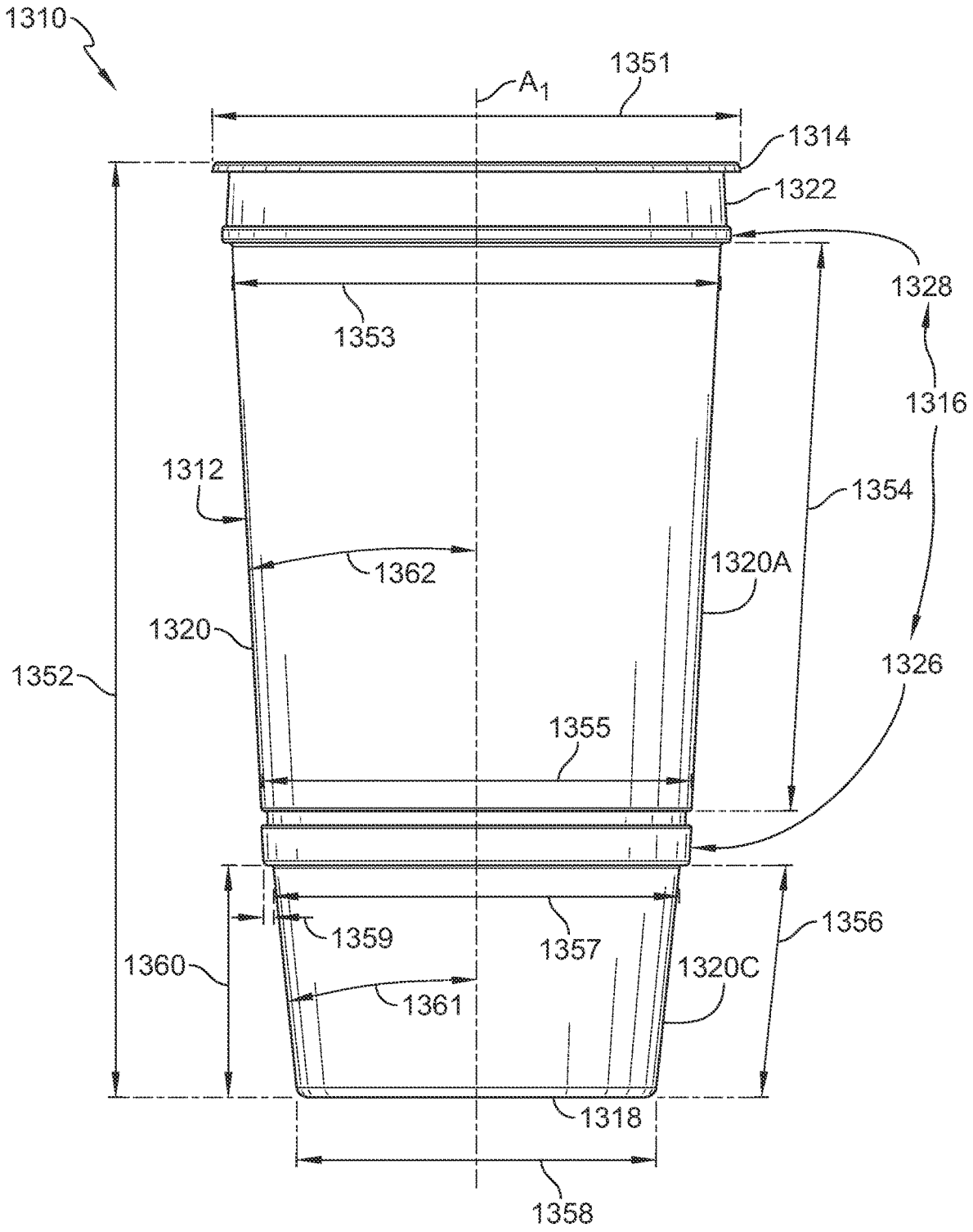
FIG. 19 is a side-elevation view another embodiment of a drink cup in accordance with the present disclosure.

Another embodiment of a drink cup 1310 in accordance with the present disclosure is shown in FIG. 19. Drink cup 1310 includes a body 1312, a brim 1314, and a body-strengthening system 1316. Body-strengthening system 1316 is coupled to body 1312 between floor 1318 and brim 1314 and is configured to provide means for minimizing a weight of drink cup 1310 while maximizing the rigidity of a selected portion of drink cup 1310 so that unintended deformation of drink cup 1310 is minimized.

Body 1312 includes floor 1318, side wall 1320, and stack shoulder 1324 as shown in FIG. 19. Floor 1318 cooperates with side wall 1320 to define interior region 1322 to hold fluid therein. Side wall 1320 extends away from floor 1318 towards brim 1314 along central axis A1 as shown in FIG. 19. Stack shoulder 1324 extends between and interconnects side wall 1320 and brim 1314, as shown in FIG. 19.

Body-strengthening system 1316 includes a first strengthening unit 1326 and a second strengthening unit 1328, as shown in FIG. 19. First strengthening unit 1326 extends between and interconnects an upper portion 1320A of side wall 1320 and a lower portion 1320C of side wall 1320, as shown in FIG. 19. Second strengthening unit 1328 extends between and interconnects an upper portion 1320A of side wall 1320 and stack shoulder 1324 as shown in FIG. 19. First strengthening unit 1326 and second strengthening unit 1328 cooperate to increase rigidity for a portion of side wall 1320.

TABLE 13

Dimensions of drink cup 1310.

| Dimension | Measurement |
|---|---|
| 1351 | 4.6" |
| 1352 | 8.1" |
| 1353 | 4.2" |
| 1354 | 4.8" |
| 1355 | 3.7" |
| 1356 | 1.9" |
| 1357 | 3.5" |
| 1358 | 3.1" |
| 1359 | 0.1" |
| 1360 | 3.0" |
| 1361 | 6.0° |
| 1362 | 3.0° |

*all dimensions are approximate

Figure 20:
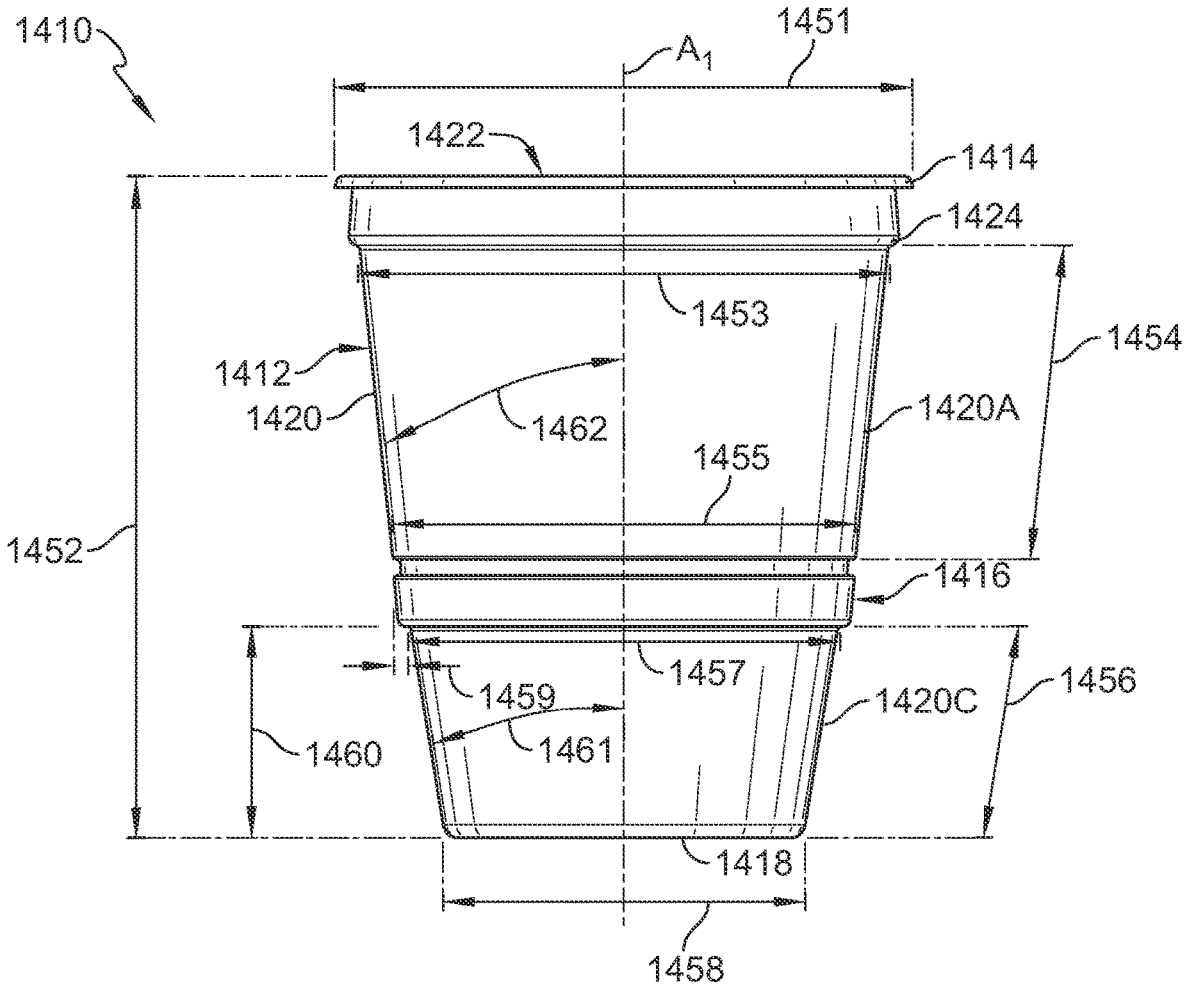
FIG. 20 is a side-elevation view another embodiment of a drink cup in accordance with the present disclosure.

Another embodiment of a drink cup 1410 in accordance with the present disclosure is shown in FIG. 20. Drink cup 1410 includes a body 1412, a brim 1414, and a body-strengthening system 1416. Body-strengthening system 1416 is coupled to body 1412 between floor 1418 and brim 1414 and is configured to provide means for minimizing a weight of drink cup 1410 while maximizing the rigidity of a selected portion of drink cup 1410 so that unintended deformation of drink cup 1410 is minimized.

Body 1412 includes floor 1418, side wall 1420, and stack shoulder 1424 as shown in FIG. 20. Floor 1418 cooperates with side wall 1420 to define interior region 1422 to hold fluid therein. Side wall 1420 extends away from floor 1418 towards brim 1414 along central axis A1 as shown in FIG. 20. Stack shoulder 1424 extends between and interconnects side wall 1420 and brim 1414, as shown in FIG. 20.

Body-strengthening system 1416 is located between an upper portion 1420A of side wall 1420 and a lower portion 1420C of side wall 1420, as shown in FIG. 20. Body-strengthening system 1416 is configured to increase rigidity for a portion of side wall 1420.

TABLE 14

Dimensions of drink cup 1410.

| Dimension | Measurement |
|---|---|
| 1451 | 4.1" |
| 1452 | 4.8" |
| 1453 | 3.8" |
| 1454 | 2.2" |
| 1455 | 3.3" |
| 1456 | 1.4" |
| 1457 | 3.0" |
| 1458 | 2.6" |
| 1459 | 0.1" |
| 1460 | 1.5" |
| 1461 | 9.2° |
| 1462 | 6.0° |

*all dimensions are approximate

Figure 21:
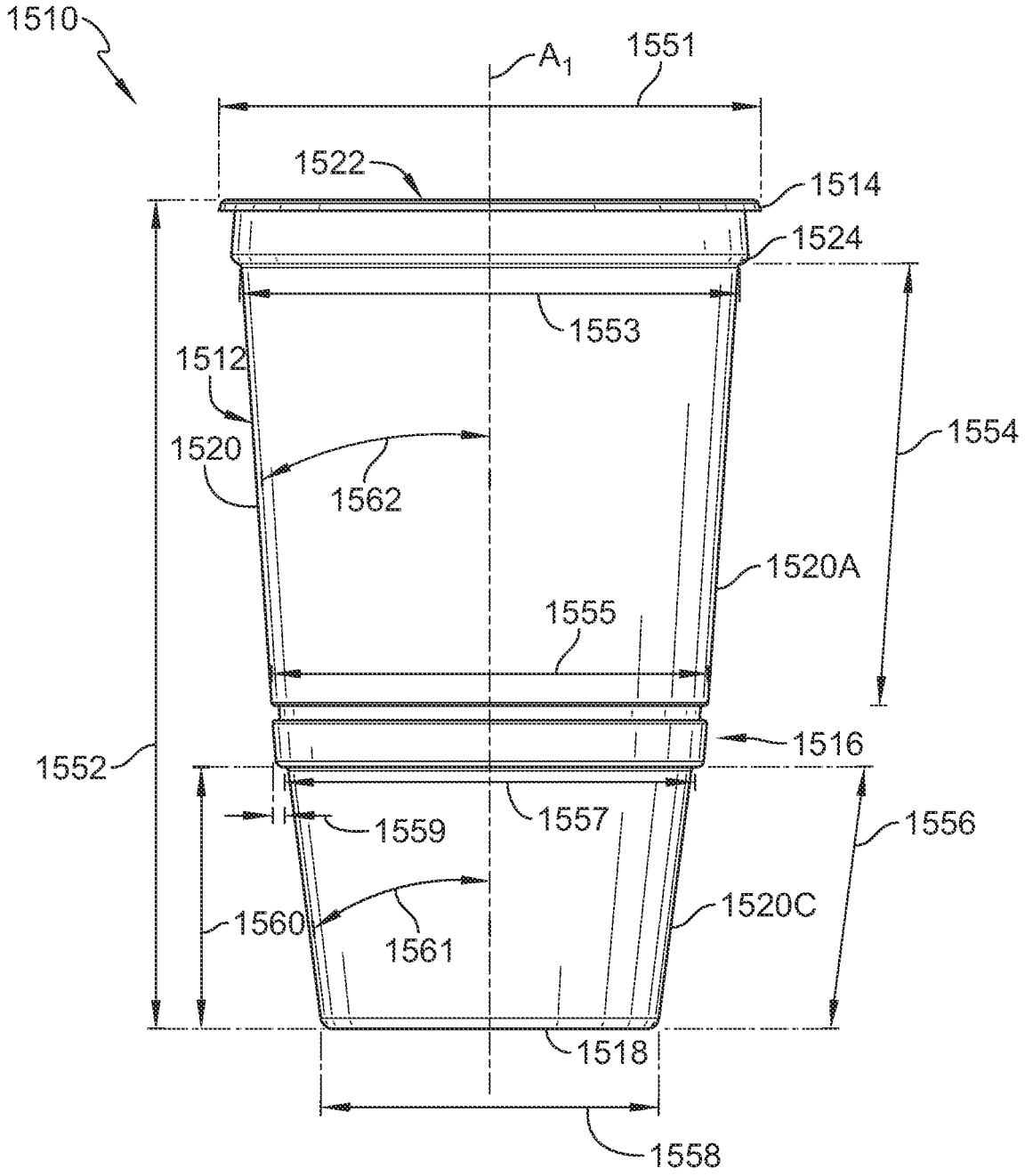
FIG. 21 is a side-elevation view another embodiment of a drink cup in accordance with the present disclosure.

Another embodiment of a drink cup 1510 in accordance with the present disclosure is shown in FIG. 21. Drink cup 1510 includes a body 1512, a brim 1514, and a body-strengthening system 1516. Body-strengthening system 1516 is coupled to body 1512 between floor 1518 and brim 1514 and is configured to provide means for minimizing a weight of drink cup 1510 while maximizing the rigidity of a selected portion of drink cup 1510 so that unintended deformation of drink cup 1510 is minimized.

Body 1512 includes floor 1518, side wall 1520, and stack shoulder 1524 as shown in FIG. 21. Floor 1518 cooperates with side wall 1520 to define interior region 1522 to hold fluid therein. Side wall 1520 extends away from floor 1518 towards brim 1514 along central axis A1 as shown in FIG. 21. Stack shoulder 1524 extends between and interconnects side wall 1520 and brim 1514, as shown in FIG. 21.

Body-strengthening system 1516 is located between an upper portion 1520A of side wall 1520 and a lower portion 1520C of side wall 1520, as shown in FIG. 21. Body-strengthening system 1516 is configured to increase rigidity for a portion of side wall 1520.

TABLE 15

Dimensions of drink cup 1510.

| Dimension | Measurement |
|---|---|
| 1551 | 4.1" |
| 1552 | 6.4" |
| 1553 | 3.8" |
| 1554 | 3.3" |
| 1555 | 3.3" |
| 1556 | 1.9" |
| 1557 | 3.1" |
| 1558 | 2.6" |
| 1559 | 0.1" |
| 1560 | 2.0" |
| 1561 | 7.2° |
| 1562 | 4.0° |

*all dimensions are approximate

Figure 22:
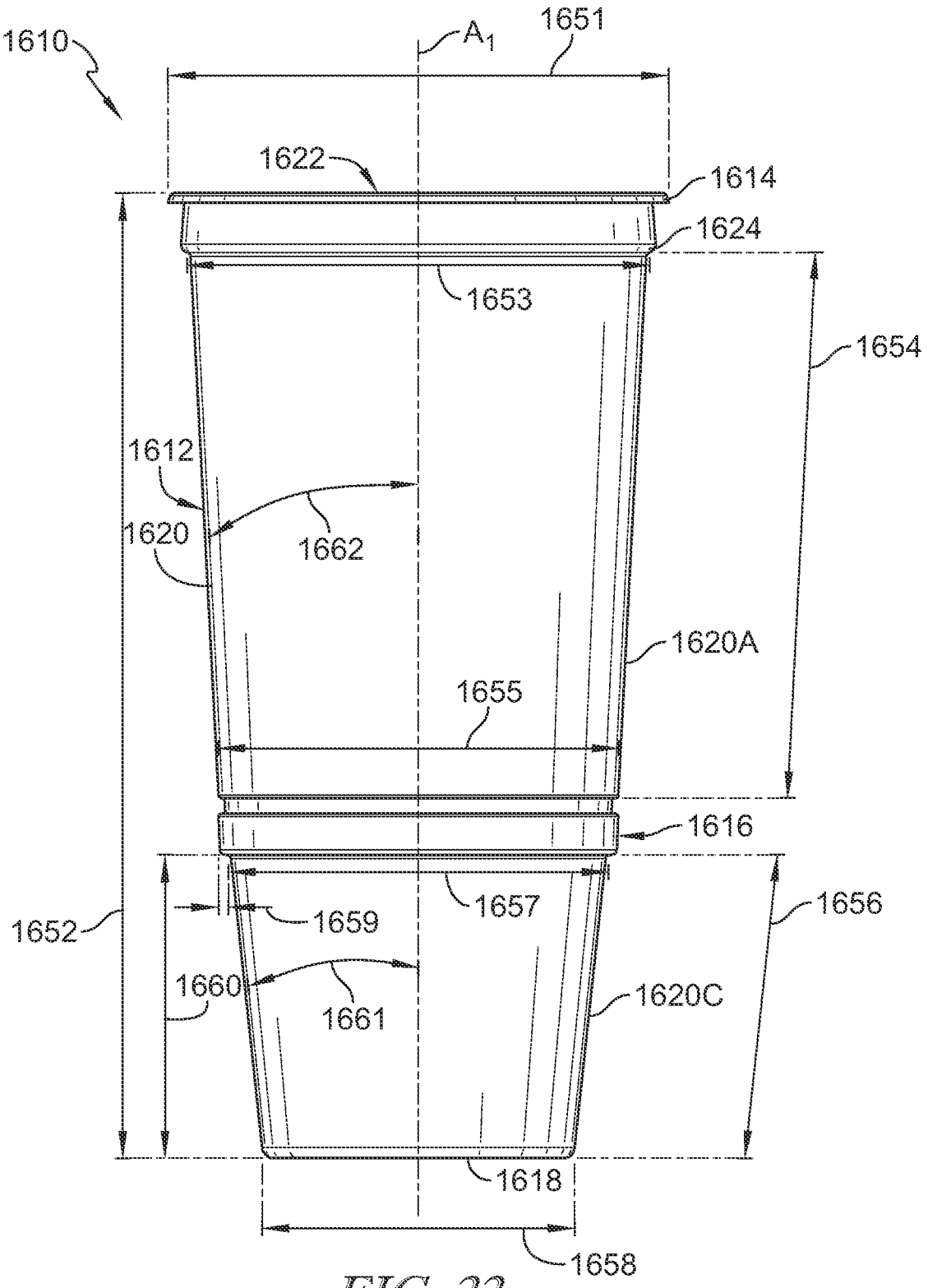
FIG. 22 is a side-elevation view another embodiment of a drink cup in accordance with the present disclosure.

Another embodiment of a drink cup 1610 in accordance with the present disclosure is shown in FIG. 22. Drink cup 1610 includes a body 1612, a brim 1614, and a body-strengthening system 1616. Body-strengthening system 1616 is coupled to body 1612 between floor 1618 and brim 1614 and is configured to provide means for minimizing a weight of drink cup 1610 while maximizing the rigidity of a selected portion of drink cup 1610 so that unintended deformation of drink cup 1610 is minimized.

Body 1612 includes floor 1618, side wall 1620, and stack shoulder 1624 as shown in FIG. 22. Floor 1618 cooperates with side wall 1620 to define interior region 1622 to hold fluid therein. Side wall 1620 extends away from floor 1618 towards brim 1614 along central axis A1 as shown in FIG. 22. Stack shoulder 1624 extends between and interconnects side wall 1620 and brim 1614, as shown in FIG. 22.

Body-strengthening system 1616 is located between an upper portion 1620A of side wall 1620 and a lower portion 1620C of side wall 1620, as shown in FIG. 22. Body-strengthening system 1616 is configured to increase rigidity for a portion of side wall 1620.

TABLE 16

Dimensions of drink cup 1610.

| Dimension | Measurement |
|---|---|
| 1651 | 4.1" |
| 1652 | 8.0" |
| 1653 | 3.8" |
| 1654 | 4.5" |
| 1655 | 3.3" |
| 1656 | 2.4" |
| 1657 | 3.1" |
| 1658 | 2.6" |
| 1659 | 0.1" |
| 1660 | 2.5" |
| 1661 | 6.0° |
| 1662 | — |

*all dimensions are approximate

Figure 23:
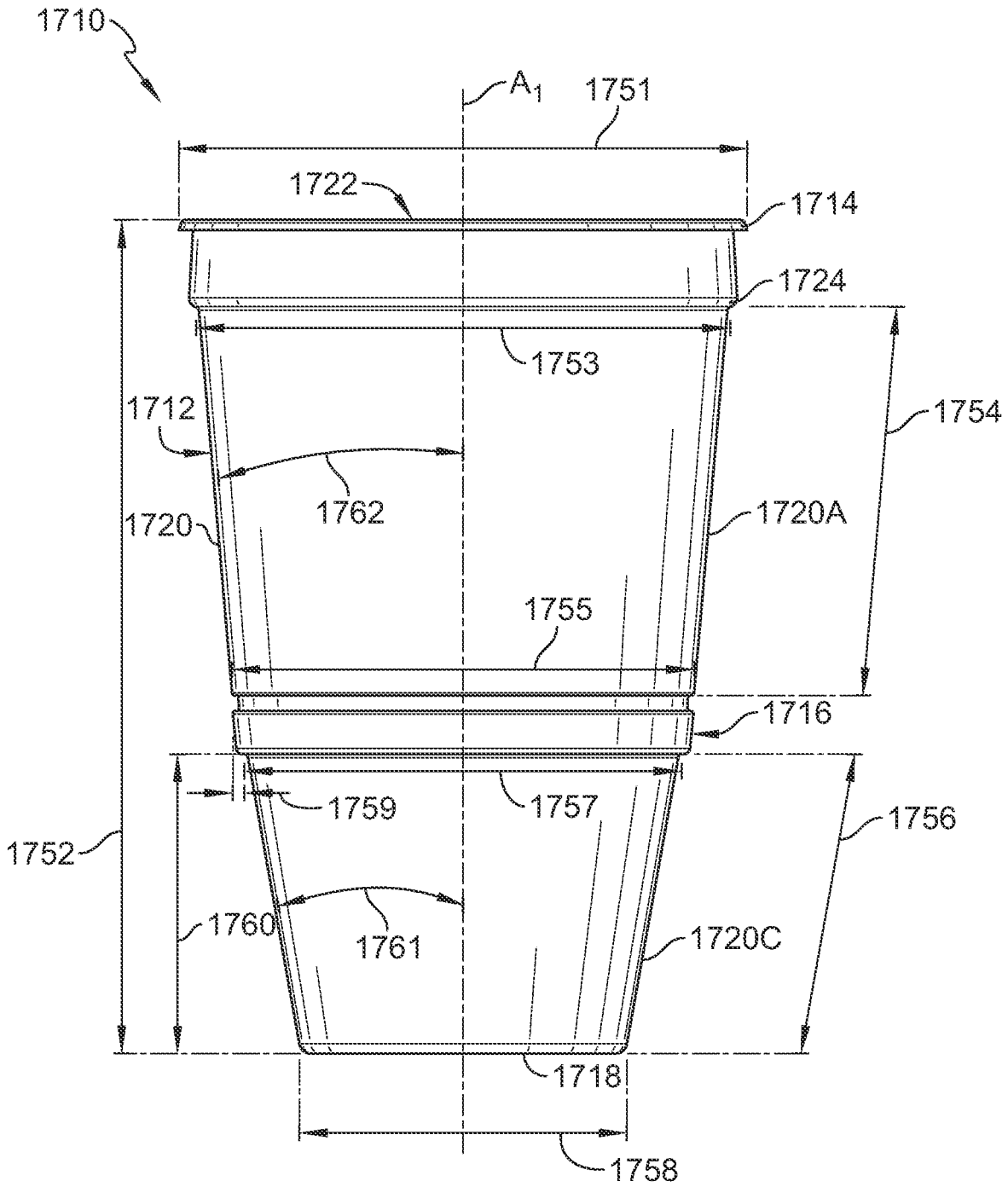
FIG. 23 is a side-elevation view another embodiment of a drink cup in accordance with the present disclosure.

Another embodiment of a drink cup 1710 in accordance with the present disclosure is shown in FIG. 23. Drink cup 1710 includes a body 1712, a brim 1714, and a body-strengthening system 1716. Body-strengthening system 1716 is coupled to body 1712 between floor 1718 and brim 1714 and is configured to provide means for minimizing a weight of drink cup 1710 while maximizing the rigidity of a selected portion of drink cup 1710 so that unintended deformation of drink cup 1710 is minimized.

Body 1712 includes floor 1718, side wall 1720, and stack shoulder 1724 as shown in FIG. 23. Floor 1718 cooperates with side wall 1720 to define interior region 1722 to hold fluid therein. Side wall 1720 extends away from floor 1718 towards brim 1714 along central axis A1 as shown in FIG. 23. Stack shoulder 1724 extends between and interconnects side wall 1720 and brim 1714, as shown in FIG. 23.

Body-strengthening system 1716 is located between an upper portion 1720A of side wall 1620 and a lower portion 1720C of side wall 1720, as shown in FIG. 23. Body-strengthening system 1716 is configured to increase rigidity for a portion of side wall 1720.

TABLE 17

Dimensions of drink cup 1710.

| Dimension | Measurement |
|---|---|
| 1751 | 4.6" |
| 1752 | 6.6" |
| 1753 | 4.2" |
| 1754 | 3.1" |
| 1755 | 3.7" |
| 1756 | 2.3" |
| 1757 | 3.4" |
| 1758 | 2.6" |
| 1759 | 0.1" |
| 1760 | 2.4" |
| 1761 | 10.0° |
| 1762 | 4.8° |

*all dimensions are approximate

Figure 24:
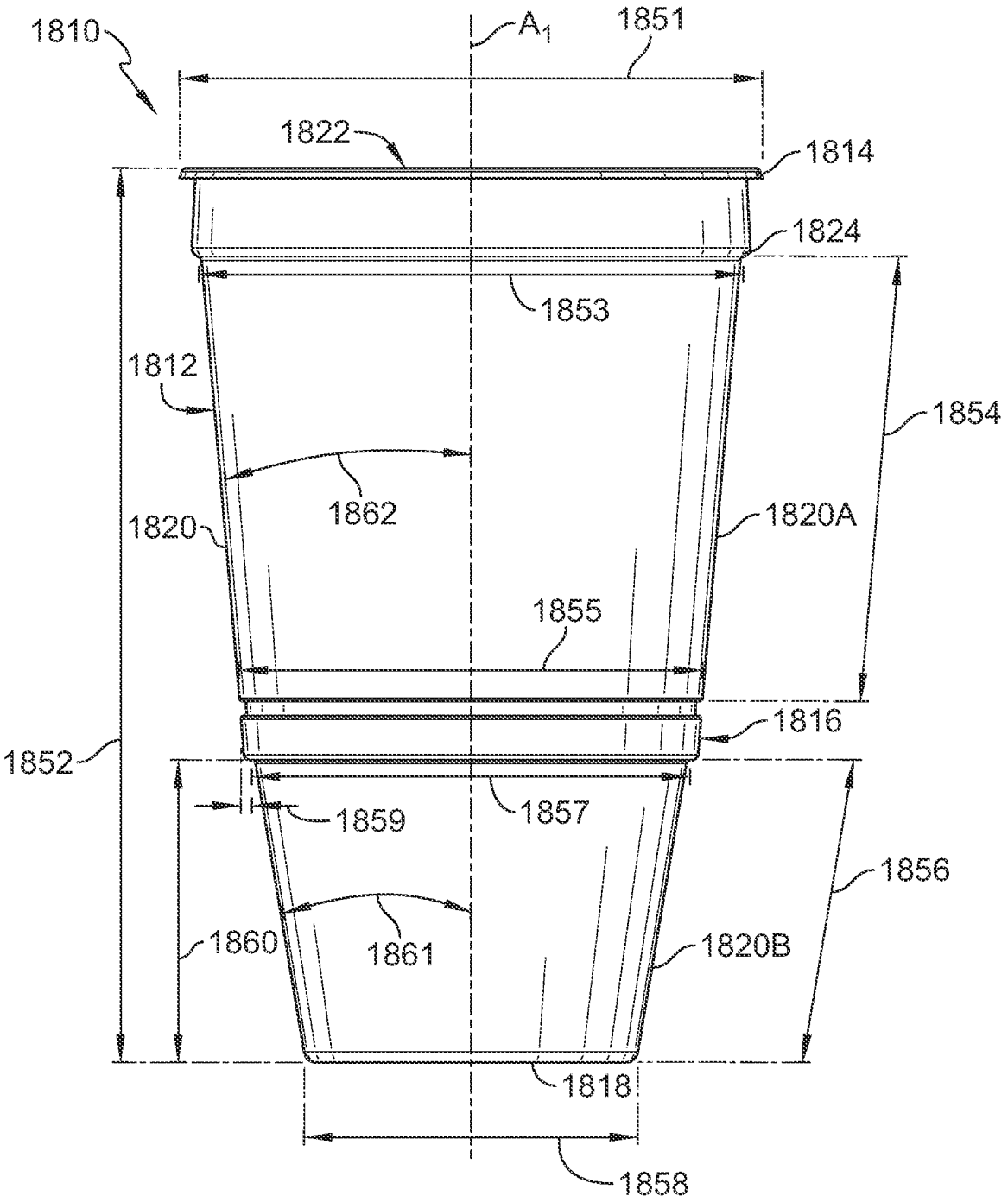
FIG. 24 is a side-elevation view another embodiment of a drink cup in accordance with the present disclosure.

Another embodiment of a drink cup 1810 in accordance with the present disclosure is shown in FIG. 24. Drink cup 1810 includes a body 1812, a brim 1814, and a body-strengthening system 1816. Body-strengthening system 1816 is coupled to body 1812 between floor 1818 and brim 1814 and is configured to provide means for minimizing a weight of drink cup 1810 while maximizing the rigidity of a selected portion of drink cup 1810 so that unintended deformation of drink cup 1810 is minimized.

Body 1812 includes floor 1818, side wall 1820, and stack shoulder 1824 as shown in FIG. 24. Floor 1818 cooperates with side wall 1820 to define interior region 1822 to hold fluid therein. Side wall 1820 extends away from floor 1818 towards brim 1814 along central axis A1 as shown in FIG. 24. Stack shoulder 1824 extends between and interconnects side wall 1820 and brim 1814, as shown in FIG. 24.

Body-strengthening system 1816 is located between an upper portion 1820A of side wall 1820 and a lower portion 1820C of side wall 1820, as shown in FIG. 24. Body-strengthening system 1816 is configured to increase rigidity for a portion of side wall 1820.

TABLE 18

| Dimensions of drink cup 1810. | |
|---|---|
| Dimension | Measurement |
| 1851 | 4.6" |
| 1852 | 7.0" |
| 1853 | 4.2" |
| 1854 | 3.5" |
| 1855 | 3.6" |
| 1856 | 2.3" |
| 1857 | 3.4" |
| 1858 | 2.6" |
| 1859 | 0.1" |
| 1860 | 2.4" |
| 1861 | 9.4° |
| 1862 | 4.8° |

*all dimensions are approximate

Figure 25:
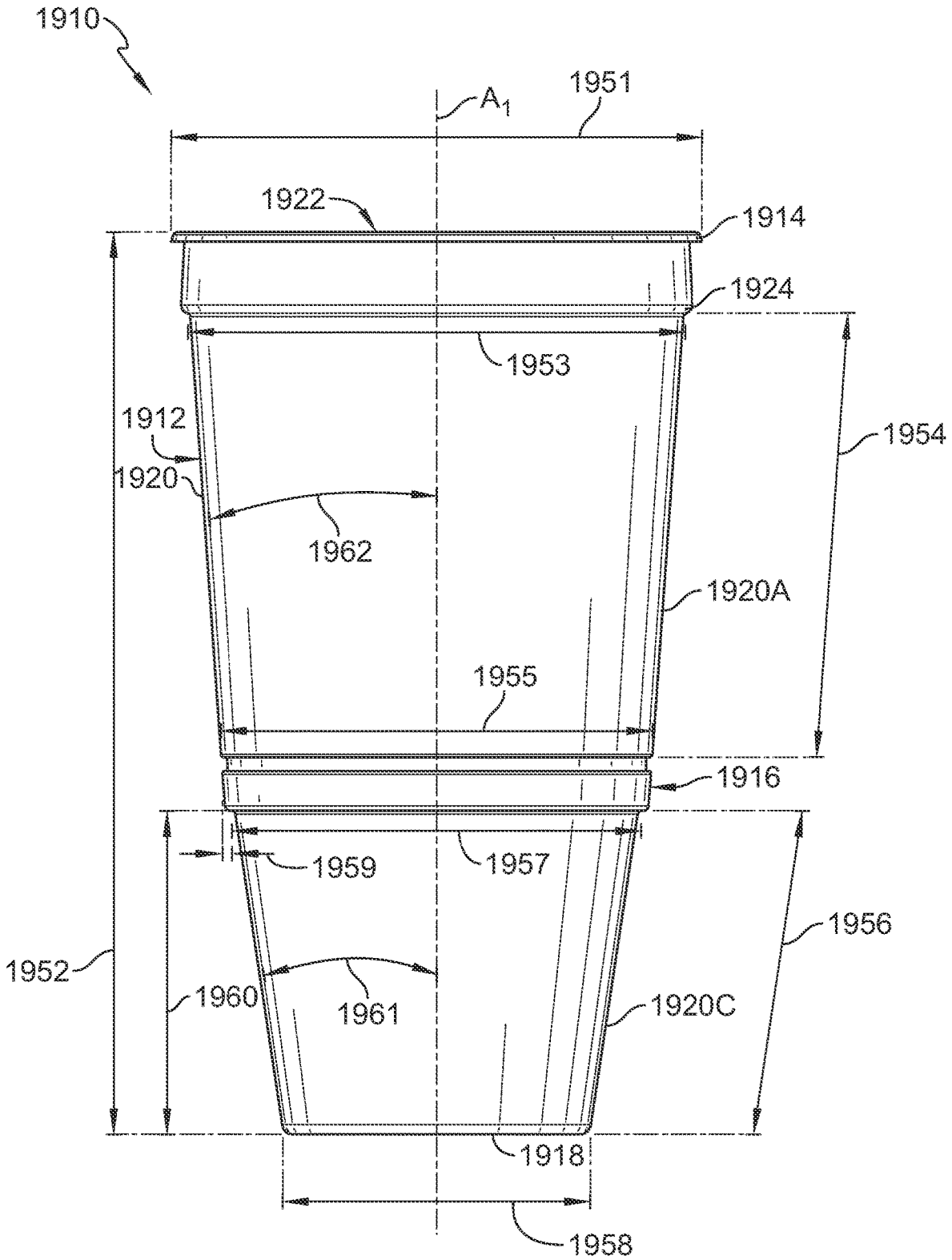
FIG. 25 is a side-elevation view another embodiment of a drink cup in accordance with the present disclosure.

Another embodiment of a drink cup 1910 in accordance with the present disclosure is shown in FIG. 25. Drink cup 1910 includes a body 1912, a brim 1914, and a body-strengthening system 1916. Body-strengthening system 1916 is coupled to body 1912 between floor 1918 and brim 1914 and is configured to provide means for minimizing a weight of drink cup 1910 while maximizing the rigidity of a selected portion of drink cup 1910 so that unintended deformation of drink cup 1910 is minimized.

Body 1912 includes floor 1918, side wall 1920, and stack shoulder 1924 as shown in FIG. 25. Floor 1918 cooperates with side wall 1920 to define interior region 1922 to hold fluid therein. Side wall 1920 extends away from floor 1918 towards brim 1914 along central axis A1 as shown in FIG. 25. Stack shoulder 1924 extends between and interconnects side wall 1920 and brim 1914, as shown in FIG. 25.

Body-strengthening system 1916 is located between an upper portion 1920A of side wall 1920 and a lower portion 1920C of side wall 1920, as shown in FIG. 25. Body-strengthening system 1916 is configured to increase rigidity for a portion of side wall 1920.

TABLE 19

| Dimensions of drink cup 1910. | |
|---|---|
| Dimension | Measurement |
| 1951 | 4.6" |
| 1952 | 7.7" |
| 1953 | 4.2" |
| 1954 | 3.7" |
| 1955 | 3.7" |
| 1956 | 2.7" |
| 1957 | 3.4" |
| 1958 | 2.6" |
| 1959 | 0.1" |
| 1960 | 2.8" |
| 1961 | 8.8° |
| 1962 | 4.0° |

*all dimensions are approximate

Figure 26:
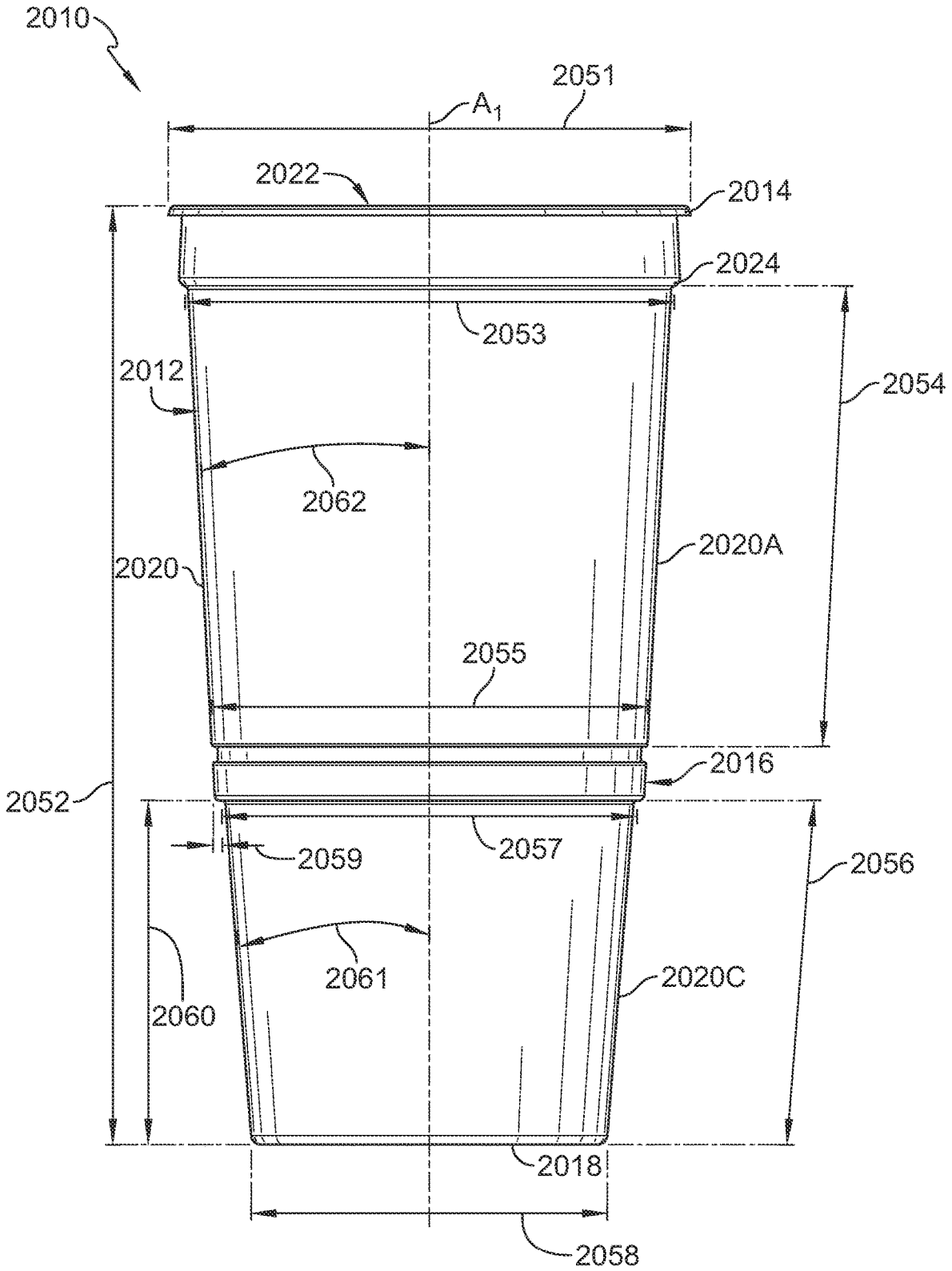
FIG. 26 is a side-elevation view another embodiment of a drink cup in accordance with the present disclosure.
Figure 27:
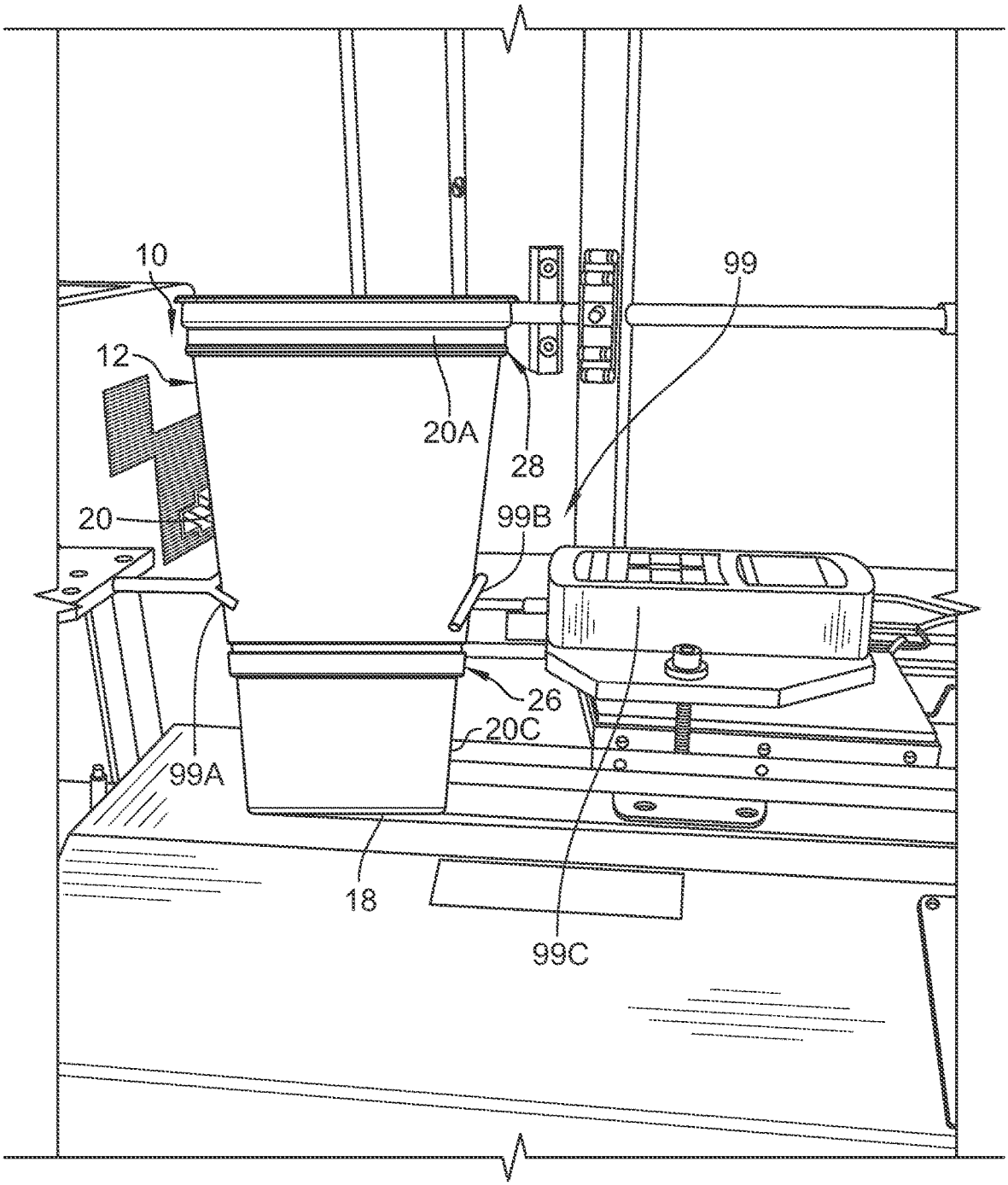
FIG. 27 is a perspective view of a Rigidity Tester used in accordance with the present disclosure.

Another embodiment of a drink cup 2010 in accordance with the present disclosure is shown in FIG. 26. Drink cup 2010 includes a body 2012, a brim 2014, and a body-strengthening system 2016. Body-strengthening system 2016 is coupled to body 2012 between floor 2018 and brim 2014 and is configured to provide means for minimizing a weight of drink cup 2010 while maximizing the rigidity of a selected portion of drink cup 2010 so that unintended deformation of drink cup 2010 is minimized.

Body 2012 includes floor 2018, side wall 2020, and stack shoulder 2024 as shown in FIG. 26. Floor 2018 cooperates with side wall 2020 to define interior region 2022 to hold fluid therein. Side wall 2020 extends away from floor 2018 towards brim 2014 along central axis A1 as shown in FIG. 26. Stack shoulder 2024 extends between and interconnects side wall 2020 and brim 2014, as shown in FIG. 26.

Body-strengthening system 2016 is located between an upper portion 2020A of side wall 2020 and a lower portion 2020C of side wall 2020, as shown in FIG. 26. Body-strengthening system 2016 is configured to increase rigidity for a portion of side wall 2020.

TABLE 20

| Dimensions of drink cup 2010. | |
|---|---|
| Dimension | Measurement |
| 2051 | 4.6" |
| 2052 | 8.2" |
| 2053 | 4.2" |
| 2054 | 4.0" |
| 2055 | 3.8" |
| 2056 | 2.9" |
| 2057 | 3.6" |
| 2058 | 3.1" |
| 2059 | 0.1" |
| 2060 | 3.0" |
| 2061 | 4.5° |
| 2062 | 3.0° |

*all dimensions are approximate

In one example, a drink cup in accordance with the present disclosure includes, from top bottom, a brim, a stack shoulder, an upper portion of a side wall, a second strengthening unit, a middle portion of the side wall, a first strengthening unit, a lower portion of the side wall, and a floor. The drink cup may have several different rigidities as measured by Example 2 below. The drink cup may have several different masses.

In one example, a drink cup in accordance with the present disclosure may have a mass less than about 17 grams, 16.5 grams, 16.1 grams, and 16 grams. The drink cup may have a stack-shoulder rigidity measured at the stack shoulder of greater than about 700 grams, 750 grams, 800 grams, 850 grams, and 875 grams. In another example, the drink cup may have a middle-portion rigidity measured at the middle portion greater than about 350 grams, greater than 400 grams, 410 grams, 420 grams, 430 grams, 440 grams, and 450 grams. In another example, the drink cup may have a strengthening-unit rigidity measured at the first strengthening unit of greater than about 600 grams, 700 grams, 800 grams, 900 grams, 1,000 grams, 1,025 grams, and 1,050 grams. In another example, the drink cup has a mass of about 16.5 grams, a stack-shoulder rigidity of about 875 grams, a middle-portion rigidity of about 450 grams, and a strengthening-unit rigidity of about 1045 grams.

A drink cup in accordance with the present disclosure may have a ratio of mass to stack-shoulder rigidity of less than about 0.019. The drink cup may have a ratio of mass to middle-portion rigidity of less than about 0.368. The drink cup may have a ratio of mass to strengthening-unit rigidity of less than about 0.016.

EXAMPLES

Example 1

Formulations

Drink Cup formulation 1 comprises

100% INSPIRE 6025N polypropylene resin available from Braskem

Drink cup formulation 2 comprises

Pro-fax SC204 polypropylene resin available from LyondellBasell

HiCal™LC $CaCO_3$ available from Heritage Plastic

Drink Cup formulation 3 comprises

20% INSPIRE 6025N available from Braskem

80% Pro-fax SC204 available from LyondellBasell

Each Drink Cup formulation is combined via blending and formed into a sheet. The formed sheet is then introduced to a thermoforming process to form drink cups 10.

Example 2

Rigidity Test

General Procedure

Rigidity testing determines how resistant drink cups are to deformation. Various drink cups 10 in accordance with the present disclosure were subjected to rigidity testing. Each drink cup was placed in a rigidity tester as shown in FIG. 27 and tested to determine rigidity as shown below in Tables 21 and 22. Each drink cup was unlidded and unfilled during testing. Testing involved placing a drink cup 10 in a rigidity tester 99 as shown in FIG. 27. The rigidity tester 99 included a stationary stop 99*a* on a left side, and a movable anvil 99*b* and a force gauge 99*c* on a right side. The movable anvil was generally T-shaped as shown in FIG. 27. Rigidity was measured at locations corresponding to the stack shoulder, the middle portion of the side wall, and the first strengthening unit of drink cup 10. Reference cups not containing the body-strengthening system were measured in the same locations as drink cup 10.

Example 3

Rigidity Results

Drink cups and reference cups formed from a thermoforming process using material corresponding to the formulations of Example 1 were analyzed according to Example 2. Approximately 6 cups were sampled from each run. Results from the rigidity testing are shown below in Table 21.

TABLE 21

Rigidity results from drink cups and reference cups formed on tool lines.

| Line | Description | Formulation | Weight (g) | Stack Shoulder Rigidity (g) | Middle Rigidity (g) | First strengthening unit rigidity (g) |
|---|---|---|---|---|---|---|
| A | Drink Cup | 1 | 16.1 | 1862 | 1093 | 2029 |
| B | Drink Cup | 2 | 16.0 | 1820 | 1016 | 1630 |
| C | Reference Cup | 1 | 16.1 | 814 | 883 | 1569 |
| D | Reference Cup | 2 | 20.3 | 417 | 354 | 410 |

Example 4

Rigidity Results from Production Lines

Drink cups and reference cups formed from a thermoforming process using material corresponding to the formulations of Example 1 were analyzed according to Example 2. Approximately 6 cups were sampled from each run. Results from the rigidity testing are shown below in Table 22.

TABLE 22

Rigidity results from drink cups and reference cups formed on production lines.

| Line | Description | Formulation | Weight (g) | Stack Shoulder Rigidity (g) | Middle Rigidity (g) | First strengthening unit rigidity (g) |
|---|---|---|---|---|---|---|
| P1 | Drink Cup | 3 | 16.5 g | 876 | 448 | 1044 |
| P1 | Reference Cup | 3 | 16.2 g | 697 | 354 | 561 |
| P2 | Reference Cup | 3 plus regrind | 20.7 g | | 395 | |
| P1 | Reference Cup | 3 | 18.5 g | 722 | 485 | 856 |

The invention claimed is:

1. A drink cup comprises a body including a floor and a side wall coupled to the floor to extend upwardly away from the floor and spaced from a central axis to define an interior region configured to provide a fluid-holding reservoir, a brim coupled to the body to locate the side wall between the brim and the floor and formed to include an opening into the interior region, and a body-strengthening system coupled to the body between the floor and the brim, wherein the body-strengthening system includes a first strengthening unit located between a lower portion of the side wall and an upper portion of the side wall and a second strengthening unit located between the first strengthening unit and the brim, wherein the first strengthening unit includes a first annular strip that extends radially away from the central axis, a second annular strip spaced apart from the first annular strip and that extends radially outward away from the central axis, and an annular band that extends between and interconnects radially outer ends of the first annular strip and the second annular strip, wherein the second strengthening unit includes a first annular strip that extends radially away from the central axis, a second annular strip spaced apart from the first annular strip and that extends radially outward away from the central axis, and an annular band that extends between and interconnects radially outer ends of the first annular strip and the second annular strip, and wherein the first strengthening unit is located below a point located halfway between the floor and the brim along the central axis and the second strengthening unit is located closer to the brim than the point located halfway between the floor and the brim along the central axis.

2. The drink cup of claim 1, wherein the annular band of the first strengthening unit has a first height and the annular band of the second strengthening unit has a second height less than the first height.

3. The drink cup of claim 1, wherein the a radially inner end of the first annular strip of the first strengthening unit is spaced a first distance from the central axis and a radially inner end of the second annular strip of the first strengthening unit is spaced a second distance from the central axis less than the first distance.

4. The drink cup of claim 1, wherein a radially inner end of the first annular strip of the second strengthening unit is spaced a first distance from the central axis and a radially inner end of the second annular strip of the second strengthening unit is spaced a second distance from the central axis less than the first distance the lower-strengthening segment includes an annular band that has a distance from the central axis that is greater than the distance from the central axis to the lower portion of the side wall and the distance from the central axis to the middle portion of the side wall.

5. The drink cup of claim 4, wherein the first strengthening unit includes a lower strengthening segment and an upper strengthening segment, the lower strengthening segment having the first annular strip, the second annular strip, and the annular band, the upper strengthening segment positioned between the lower strengthening segment and the second strengthening unit.

6. The drink cup of claim 1, wherein the second strengthening unit provides a stack shoulder.

7. The drink cup of claim 6, wherein the annular ring includes an annular band that has a distance from the central axis greater than a distance from the central axis to the upper portion of the side wall and the middle portion of the side wall.

8. The drink cup of claim 7, wherein the body further includes a stack shoulder located between the second strengthening unit and the brim.

9. The drink cup of claim 8, wherein the lower-strengthening segment and the annular ring are C-shaped.

10. The drink cup of claim 8, wherein the distance from the central axis to the annular band of the annular ring is less than a distance from the central axis to the stack shoulder.

11. The drink cup of claim 1, wherein the drink cup has a mass, a stack-shoulder rigidity measured at the stack shoulder, a middle-portion rigidity measured at the middle portion, and a strengthening-unit rigidity measured at the first strengthening unit and a ratio of the mass to the stack-shoulder rigidity is less than 0.019.

12. The drink cup of claim 11, wherein a ratio of the mass to the strengthening-unit rigidity is less than 0.016.

13. The drink cup of claim 12, wherein a ratio of the mass to the middle-portion rigidity is less than about 0.368.

14. The drink cup of claim 1, wherein a rigidity measured at the middle portion is greater than about 400 grams.

15. The drink cup of claim 1, wherein a rigidity measured at the first strengthening unit is greater than about 1,000 grams.

16. The drink cup of claim 1, wherein a mass of the drink cup is less than 17 grams.

17. The drink cup of claim 1, wherein the drink cup has a mass, a middle-portion rigidity measured at the middle portion, and a strengthening-unit rigidity measured at the first strengthening unit and a ratio of the mass to the stack-shoulder rigidity is less than 0.019.

18. The drink cup of claim 17, wherein a ratio of the mass to the strengthening-unit rigidity is less than 0.016 and a ratio of the mass to the middle-portion rigidity is less than about 0.368.

19. The drink cup of claim 1, wherein the opening has a radius, at least a portion of the second strengthening unit is located a distance from the central axis, and the distance is greater than the radius.

20. The drink cup of claim 1, wherein a portion of the second strengthening unit is spaced further from the central axis than the side wall of the drink cup between the second strengthening unit and the brim.

* * * * *